US007000532B2

(12) United States Patent
Imperato

(10) Patent No.: US 7,000,532 B2
(45) Date of Patent: Feb. 21, 2006

(54) PORTABLE TRASH COMPACTOR

(76) Inventor: John Imperato, 191 Eastwood Blvd., Centereach, NY (US) 11720

( * ) Notice: Subject to any disclaimer, the term of this patent is extended or adjusted under 35 U.S.C. 154(b) by 153 days.

(21) Appl. No.: 10/735,838

(22) Filed: Dec. 15, 2003

(65) Prior Publication Data

US 2005/0126405 A1 Jun. 16, 2005

(51) Int. Cl.
*B30B 9/00* (2006.01)

(52) U.S. Cl. ..... 100/52; 100/99; 100/100; 100/102; 100/229 A; 100/240

(58) Field of Classification Search ..... 100/52, 100/99, 100, 102, 214, 229 A, 240, 246; 248/311.2; 108/44; 312/237, 312, 351.1, 312/31; 220/908
See application file for complete search history.

(56) References Cited

U.S. PATENT DOCUMENTS

| | | | | |
|---|---|---|---|---|
| 3,527,161 A | | 9/1970 | Brown et al. | |
| 3,602,136 A | | 8/1971 | Ligh | |
| 3,659,427 A | | 5/1972 | Harza | |
| 3,688,686 A | | 9/1972 | Ligh | |
| 3,754,503 A | * | 8/1973 | Hennells | 100/229 A |
| 3,802,337 A | | 4/1974 | St-Hiliare | |
| 3,807,299 A | | 4/1974 | Engebretsen | |
| 3,929,060 A | * | 12/1975 | Burke | 100/100 |
| 4,022,123 A | | 5/1977 | Bachmann | |
| 4,072,097 A | * | 2/1978 | Seibel | 100/100 |
| 4,073,228 A | | 2/1978 | Henzl | |
| 4,147,100 A | | 4/1979 | Dykstra | |
| 4,188,873 A | | 2/1980 | Gattyan | |
| 4,735,136 A | | 4/1988 | Lee et al. | |
| 4,989,506 A | * | 2/1991 | McCormick | 100/90 |
| 5,088,396 A | * | 2/1992 | Thomas | 100/35 |
| 6,676,362 B1 | * | 1/2004 | Pickering | 414/517 |
| 6,779,769 B1 | * | 8/2004 | York et al. | 248/311.2 |

FOREIGN PATENT DOCUMENTS

| | | |
|---|---|---|
| WO | WO02/06039 | 1/2002 |

* cited by examiner

*Primary Examiner*—Derris H. Banks
*Assistant Examiner*—Jimmy Nguyen
(74) *Attorney, Agent, or Firm*—Michael I. Kroll

(57) ABSTRACT

An portable apparatus for compacting refuse including an outer housing having a recess extending therethrough and a vent extending therethrough. An inner housing is received within the outer housing so as to form a compartment for receiving refuse therein. A connection means releaseably connects the outer housing to the inner housing. A base including a mounting port selectively receives the inner and outer housing. The base is selectively mountable on a center console in a vehicle. A compacting means for compacting the refuse within the compartment. The apparatus further includes a means for freshening an area around the apparatus. An activation button is connected to the compacting means. Upon the refuse being received within the compartment through the recess, the activation button is activated and the compacting means causes the refuse to be compacted and the freshening means sprays an air freshening mist though the vent thereby causing the area around the apparatus to be made fresh.

17 Claims, 18 Drawing Sheets

PORTABLE TRASH COMPACTOR

BACKGROUND OF THE INVENTION

Field of the Invention

The present invention relates generally to trash compactors and, more specifically, to a portable trash compactor that may be operated by a plurality of power sources and is easily transportable for use in various settings. The portable trash compactor includes an outer housing and an inner housing. The outer housing includes a recess for receiving trash therethrough. The trash is further received by a bin positioned within the inner housing. Upon the level of trash in the bin reaching a predetermined level, a motor is activated and causes a drive member to be driven into the bin for compacting the trash contained therein. The trash is easily removeable from the trash bin and the compactor is then ready to receive additional trash for compacting.

DESCRIPTION OF THE PRIOR ART

There are other trash compacting devices designed for compressing waste. Typical of these is U.S. Pat. No. 3,527,161 issued to Gordon H. Brown et al. on Sep. 8, 1970.

Another patent was issued to David R. Ligh on Aug. 31, 1971 as U.S. Pat. No. 3,602,136. Yet another U.S. Pat. No. 3,659,427 was issued to Richard D. Harza on May 2, 1972 and still yet another was issued on Sep. 5, 1972 to David R. Ligh as U.S. Pat. No. 3,688,686. Another patent was issued to Fernando St. Hillaire on Apr. 9, 1974 as U.S. Pat. No. 3,802,337. Yet another U.S. Pat. No. 3,807,299 was issued to Einar O. Engebretsen on Apr. 30, 1974. Another was issued to Hans Bachman on May 10, 1977 as U.S. Pat. No. 4,022,123 and still yet another was issued on Feb. 14, 1978 to Jerry Henzi as U.S. Pat. No. 4,073,228. Donald P. Dykstra was issued U.S. Pat. No. 4,147,100 on Apr. 3, 1979 and U.S. Pat. No. 4,188,873 was issued to Andor Gattyan on Feb. 19, 1980. U.S. Pat. No. 4,735,136 was issued to Kenneth M. Lee et al. on Apr. 5, 1988 and International Patent No. WO 02/06039 was issued to John Freeberg on 24 Jan. 2002.

While these trash compactors may be suitable for the purposes for which they were designed, they would not be as suitable for the purposes of the present invention, as hereinafter described.

U.S. Pat. No. 3,527,161

Inventor: Gordon H. Brown et al.

Issued: Sep. 8, 1970

A domestic refuse compactor including a receptacle in which household refuse is compacted by a ram to a fraction of its former volume. The ram is operated to compact the refuse with a preselected maximum force by means of a pair of axially fixed rotatable screws axially driving a pair of nuts threadedly mounted thereon. The nuts are yieldably connected to the ram through a corresponding pair of coil springs coaxially about the respective screws. Switches are provided responding to a preselected contraction of the springs corresponding to the preselected maximum force to stop the compaction operation of the ram and cause the ram to be moved reversely to a retracted position completing the compacting operation.

U.S. Pat. No. 3,602,136

Inventor: David R. Ligh

Issued: Aug. 31, 1971

A refuse compactor has an upright housing whose internal compacting chamber is accessible by a door provided in its circumferential wall. A compacting head fills the cross section of the chamber and is guidedly slidable in axial direction thereof. A power source and motion-transmitting arrangement are provided for advancing the compacting head towards an end wall of the housing to thereby compact refuse between the end wall and the compacting head, and for subsequently withdrawing the compacting head in direction away from the one end wall for enabling removal of the compacted refuse.

U.S. Pat. No. 3,659,427

Inventor: Richard D. Harza

Issued: May 2, 1972

A garbage and refuse disposing unit is disclosed herein. The unit includes a housing for receiving refuse of all types, a compressor mechanism for compressing the refuse and freezing means for freezing the compressed refuse into dense or solid pellet-like units.

U.S. Pat. No. 3,688,686

Inventor: David R. Ligh

Issued: Sep. 5, 1972

A housing is provided with an internal chamber adapted to accommodate refuse to be compacted. A plunger is mounted in the chamber and is movable from a rest position at one end of the chamber to an advanced position adjacent the other end of the chamber and in which position refuse in the chamber is compacted, and back to its retracted rest position. Operating means is provided for automatically cycling the displacement of the plunger from and to its retracted rest positions. Initiating means is associated with the operating means for initiating the operation of the same.

U.S. Pat. No. 3,802,337

Inventor: Fernando St-Hillaire

Issued: Apr. 9, 1974

A refuse compactor comprising a housing, a main compacting member and an auxiliary compacting member slidably displaceable inside the housing, and a single hydraulic actuating unit connected to both compacting members and including a pair of hydraulic pistons concentrically mounted and arranged to cause to and fro displacement of the compacting members relative to each other and to the housing. The proposed single actuating unit results in a compactor having a relatively slender and effectively compacting shape requiring only a simple hydraulic control. Cooperating teeth are attached to the housing and to the main compacting member to shear the refuse arriving from a hopper and a guide is cooperatively associated to the main compacting member to maintain the teeth in a proper angular relationship.

U.S. Pat. No. 3,807,299

Inventor: Einar O. Engebretsen

Issued: Apr. 30, 1974

In a trash compactor which includes a ram for compacting waste materials deposited in the compactor, a two-piece, reusable liner is positioned within the compactor to receive the waste material and facilitate removal of the waste material after compaction thereof. Each of the sections is formed of a fairly rigid material, such as polyethylene, and each is provided on its outer surfaces with ribs which serve to both strengthen the liner sections and prevent the liner from sticking to the interior surfaces of the drawer. Each of these sections is constructed of integrally formed, upstanding sidewalls and a bottom wall with one side wall of each of the sections being just high enough to retain liquids within the liner while permitting their ready assembly and disassembly.

U.S. Pat. No. 4,022,123

Inventor: Hans Bachman

Issued: May 10, 1977

A garbage compactor has a rigid frame structure with a lower horizontal base plate, an upper horizontal top plate connected by three interconnecting vertical bars. An octagonal container positioned between the base plate and top plate is pivotally connected to and slidable on one of the interconnecting bars to swing outwardly for loading and unloading with a hydraulic cylinder on the top plate operating to compress garbage in the container. A hinged wall section of the container is operable to permit removal of a bag insert when filled with compacted garbage.

U.S. Pat. No. 4,073,228

Inventor: Jerry Henzl

Issued: Feb. 14, 1978

A trash compactor using a dolly as a receptacle for the trash to be compacted. The dolly is normally spring supported ready for movement into and out of the compactor, but when in the compactor and subjected to compacting pressure, the dolly is pressed downwardly, upon the beams of the main compactor frame which then takes the full compacting pressures. A novel construction of the dolly and compactor floor of the main frame makes such transfer of load possible. The compacting pressure is developed by four hydraulic cylinders, all of which are mounted on a common plate. The rod ends of the two center cylinders are connected to the top member of the main frame and the cylinder ends are connected to the common plate. The rod ends of the remaining two cylinders are connected to the main compacting plate with the cylinder ends mounted on the common plate. With the four cylinders mounted in this manner, twice the movement of the compacting ram is obtained. Safety devices include a deflection switch actuated when a deflection exceeding a given amount takes place within the frame assembly. Such deflection may be caused by solid materials, such as logs, bricks, etc., inadvertently placed in the material to be compacted. Under normal conditions, the cylinders will reverse and the unit will automatically stop once the cylinders reach the limit of their upward stroke. A magnetic switch and latch operated switches serves to prevent operation of the ram unless the trash loading door and dolly are in the closed and latched position.

U.S. Pat. No. 4,147,100

Inventor: Donald P. Dykstra

Issued: Apr. 3, 1979

A small portable housing forms a trash compacting chamber in the bottom. At one side of the housing interior, above the chamber, is a space through which trash can fall to the chamber from an upper trash compacting opening. At the other side of the interior of the housing and above the chamber is the compacting mechanism powered by a hydraulic ram. This mechanism includes a carriage supporting a two-part platen, one part of which is below the ram and fixed to the carriage and the other part of which is articulated for movement between a vertical position when raised, and a generally horizontal position across said space when being lowered. Several lost motion mechanisms are disclosed for initially so moving the articulated portion as the ram is extended and thereafter providing carriage movement. A gate is mounted to swing across the space when the platens are lowered so as to catch any trash introduced at that time. A counter is actuated by the opening of a door at the access opening and after a plurality of actuations initiates a compaction cycle. As an alternative to the counter, a timer is employed to cycle the compactor periodically.

U.S. Pat. No. 4,188,873

Inventor: Andor Gattyan

Issued: Feb. 19, 1980

A piston/cylinder type element particularly suited for embodiment in a refuse compactor as the ram thereof comprises adjustable guide means for guiding the piston-like element in sliding movement within the cylinder. The guide means are adjustable to accommodate wear in the mating surfaces thereof. There is also disclosed a discharge cone for a compactor which is releasably secured to the ramhousing structure in a selected one of a plurality of positions evenly to distribute wear on the cone produced by the passage of refuse therethrough and that cone is removable from the ram housing to be replaced by a different structure, depending upon the refuse to be compacted. Additionally, the ram member of a compactor includes novel teeth elements to cut through refuse which might otherwise be wedged between adjacent surfaces of the ram and cylinder and cause jamming.

U.S. Pat. No. 4,735,136

Inventor: Kenneth M. Lee et al.

Issued: Apr. 5, 1988

In a refuse compactor wherein refuse in a disposable bag within a receptacle is compacted by a ram driven by a reversible electric motor, a "full bag" indicator lamp is energized when the refuse compacted in the receptacle is at a predetermined level. The motor drives the ram downward into the receptacle to compact the refuse, and when the ram slows in response to the reactive load of the refuse, a centrifugal switch reverses the direction of the motor to return the ram to a rest position above the receptacle. The bag is diagnosed full to energize the indicator lamp if the ram is at a predetermined level in the receptacle when the motor reverses. The indicator lamp is controlled by a latching relay that requires only one pair of contacts to energize and latch on the lamp.

PCT Patent Number WO 02/06039

Inventor: John Freeberg

Issued: 24 Jan. 2002

A portable refuse compactor has a mobile compression frame including a base in the general shape of a "T". a trash bin bottom engagement surface on the trunk of the "T" provides a purchase point against which compacting takes place. Compacting platen is positioned above, and moveable with respect to the bin bottom engagement surface. Hydraulic ram displace platen toward the bin bottom engagement surface.

SUMMARY OF THE PRESENT INVENTION

The present invention relates generally to trash compactors and, more specifically, to a portable trash compactor that may be operated by a plurality of power sources and is easily transportable for use in various settings. The portable trash compactor includes an outer housing and an inner housing. The outer housing includes a recess for receiving trash therethrough. The trash is further received by a bin positioned within the inner housing. Upon the level of trash in the bin reaching a predetermined level, a motor is activated and causes a drive member to be driven into the bin for compacting the trash contained therein. The trash is easily removeable from the trash bin and the compactor is then ready to receive additional trash for compacting.

A primary object of the present invention is to provide a portable trash compactor that overcomes the shortcomings of the prior art.

Another, secondary object of the present invention is to provide a portable trash compactor that can be easily transported and used in plurality of locations.

Another object of the present invention is to provide a portable trash compactor that is operated by an external power source including at least one of a 110 VAC outlet and a 12 V DC motor vehicle battery.

Yet another object of the present invention is to provide a portable trash compactor having an internal rechargeable battery which is recharged by the external power source.

Still yet another object of the present invention is to provide a portable trash compactor including an outer housing and an inner housing.

A further object of the present invention is to provide a portable trash compactor wherein the outer housing is sliable along the height of the inner housing thereby providing access to an area within the inner housing.

An even further object of the present invention is to provide a portable trash compactor including an internal refuse container positioned within the inner housing for receiving refuse therein.

Yet another object of the present invention is to provide a portable trash compactor including a motor and a drive member positioning on an inner surface of the outer housing.

Still another object of the present invention is to provide a portable trash compactor wherein upon activation of the motor, the drive member is caused to extend in a direction towards the refuse bin for compacting refuse contained therein.

Another object of the present invention is to provide a portable trash compactor that may be installed in the console between the seats of vehicle.

Yet another object of the present invention is to provide a portable trash compactor that may be installed in the dashboard of a vehicle.

Still yet another object of the present invention is to provide a portable trash compactor that is simple and easy to use.

Another object of the present invention is to provide a portable trash compactor that is inexpensive to manufacture and operate.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
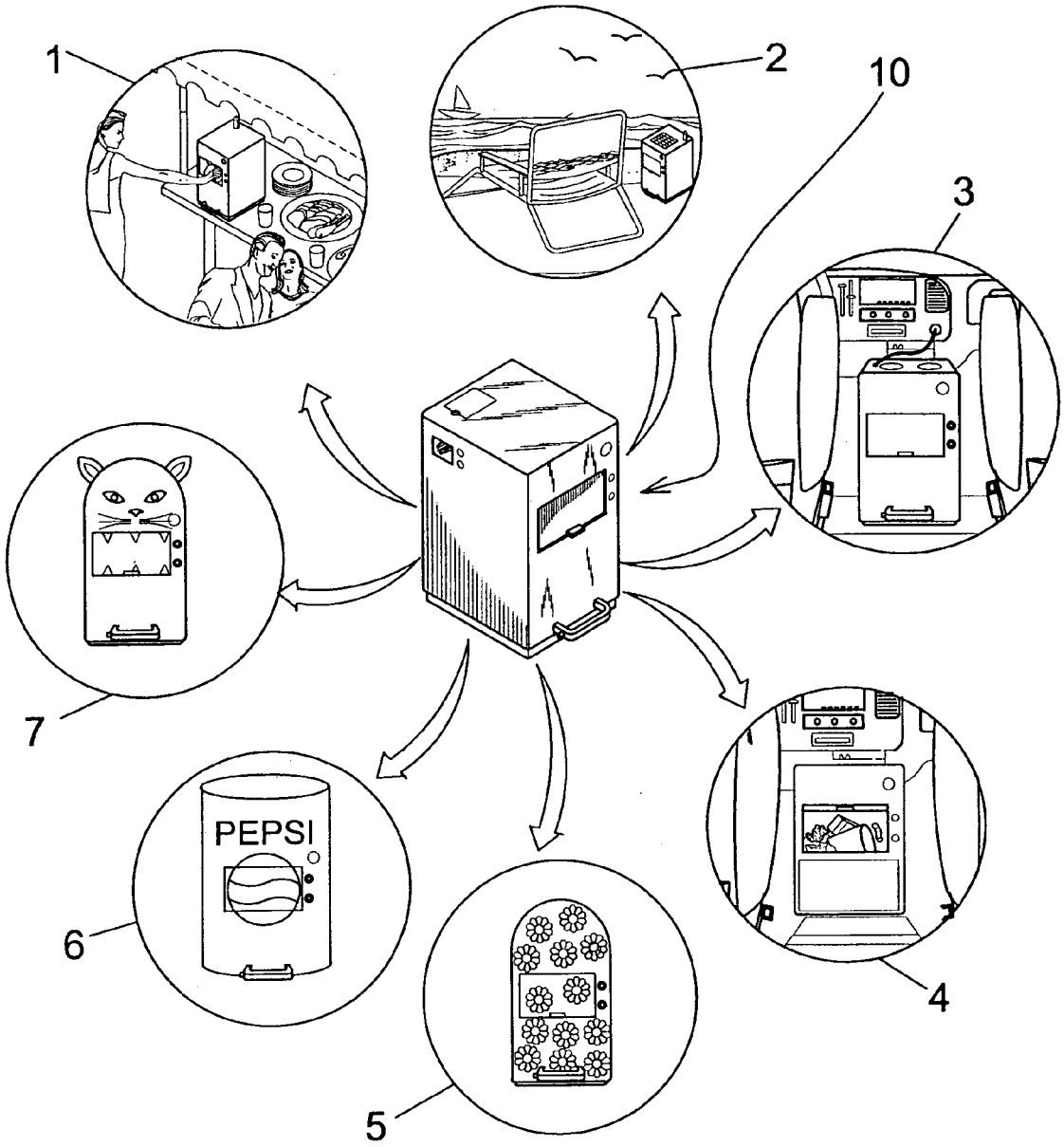
FIG. 1 is an illustrative view of a plurality of uses of the portable trash compactor of the present invention.

Turning now descriptively to the drawings, in which similar reference characters denote similar elements throughout the several views, the Figures illustrate the portable trash compactor of the present invention. With regard to the reference numerals used, the following numbering is used throughout the various drawing Figures.

10 portable trash compactor of the present invention
12 outer housing
14 inner housing
15 recess
16 access door
18 handle
20 lock release button
21 track
22 first indication light
24 second indication light
26 operation button
28 transport handle.
30 adapter compartment
32 power adapter
34 charging indication light
36 power input port
38 discharged indication light
40 compartment
42 refuse bin
44 refuse bag
46 grip
50 refuse
52 motor
54 ram
56 drive mechanism
58 rechargeable power source
60 electrical contacts
62 base
64 console
66 external power source
68 housing lock sensor
70 dashboard
72 hinged access door
74 AC power source
76 DC power source
78 control buttons
80 processor
82 indicator lights
84 pressure sensor
86 access door sensor
88 solar panel
90 beach
92 fasteners
94 fan motor
96 air freshener
98 fan blade
100 vent
102 detachable slide
103 door lock switch
104 door closed light
105 compactor full switch
106 compactor fill light
107 drive mechanism activation switch
108 drive mechanism light

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views. FIGS. 1 through 18 illustrate the portable trash compactor of the present invention indicated generally by the numeral 10.

FIG. 1 is an illustrative view of a plurality of uses of the portable trash compactor of the present invention. Shown herein are some of the possible uses of the present invention. The present invention is a portable trash compactor 10 that is selectively powerable by at least one of an internal and external power source. The portable trash compactor 10 of the present invention is compact in size and lightweight for easy transport and positioning thereof. As shown in the circle labeled 1, the portable trash compactor 10 can be used in a recreational setting. This use will be discussed in greater detail hereinafter with specific reference to FIG. 2. The circle labeled with the numeral 2 shows the portable trash compactor 10 being used at the beach. This embodiment will be discussed in greater detail hereinafter with specific reference to FIG. 13. As shown in the circle labeled with the numeral 3 and discussed in greater detail hereinafter with specific reference to FIGS. 7–9, the portable trash compactor 10 can be positioned in a center console of a vehicle. The circle labeled with the numeral 4 shows the portable trash compactor 10 of the present invention installed in the dashboard of a vehicle. This embodiment will be discussed further hereinafter with specific reference to FIG. 10. The portable trash compactor 10 of the present invention may also have a decorative outer housing as shown in the circles labeled with the numerals 5, 6 and 7 and further discussed hereinafter with specific reference to FIG. 12.

Figure 2:
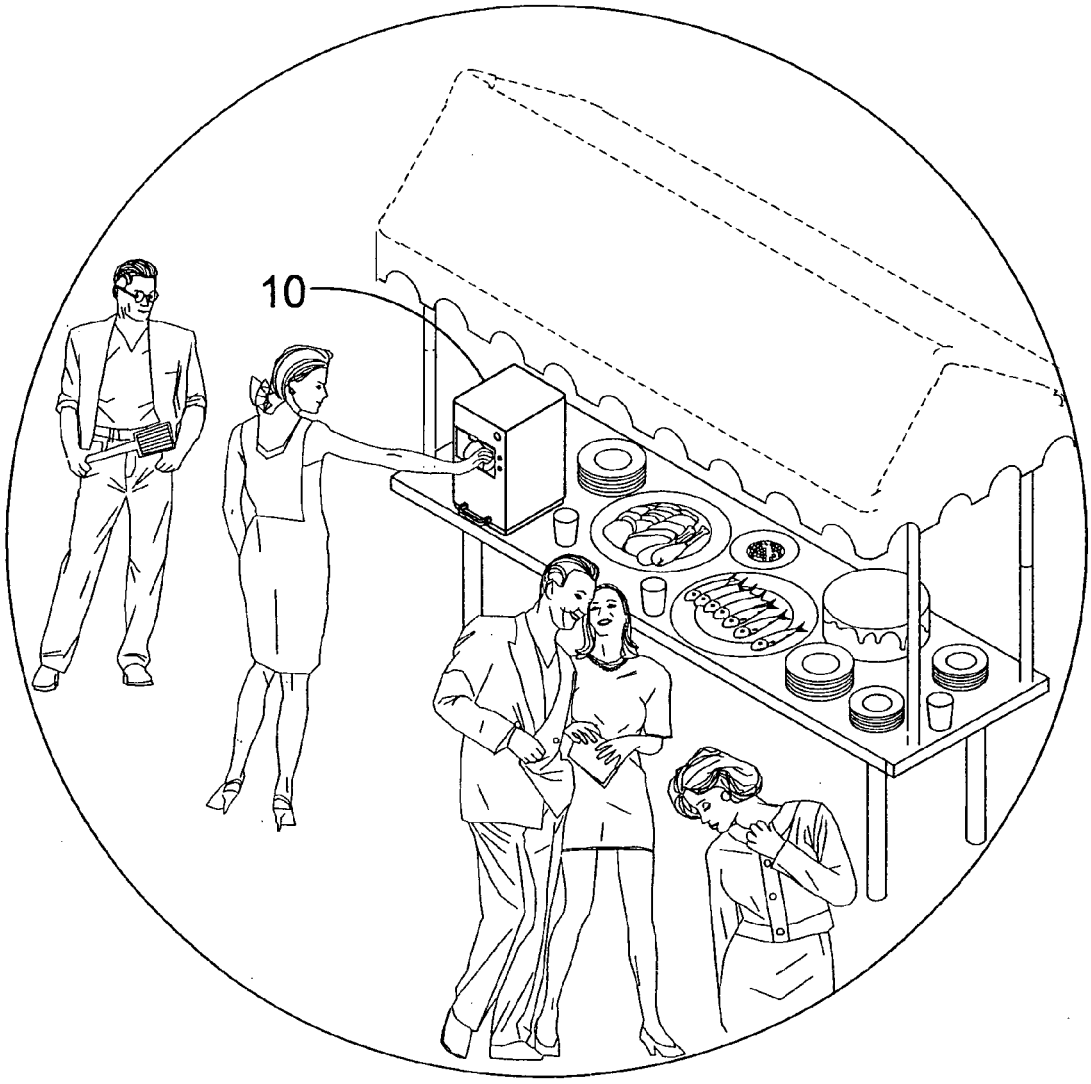
FIG. 2 is an illustrative view of the portable trash compactor of the present invention in use.

FIG. 2 is an illustrative view of the portable trash compactor of the present invention in use. Shown herein the portable trash compactor 10 of the present invention is preferably used in a recreation setting such as social gathering having a plurality of people. It is typical of social gatherings to generate a large amount of refuse therefrom. The portable trash compactor 10 is positionable on a flat surface and easily receives refuse therein. Upon activation of the portable trash compactor 10 of the present invention, the refuse contained therein is compacted and easily disposable. As shown in FIG. 2, the portable trash compactor 10 is positioned adjacent the selection of food thereby allowing uses to easily dispose of refuse therein. The portable trash compactor 10 of the present invention is environmentally friendly and reduces the amount of space required to dispose of refuse.

Figure 3:
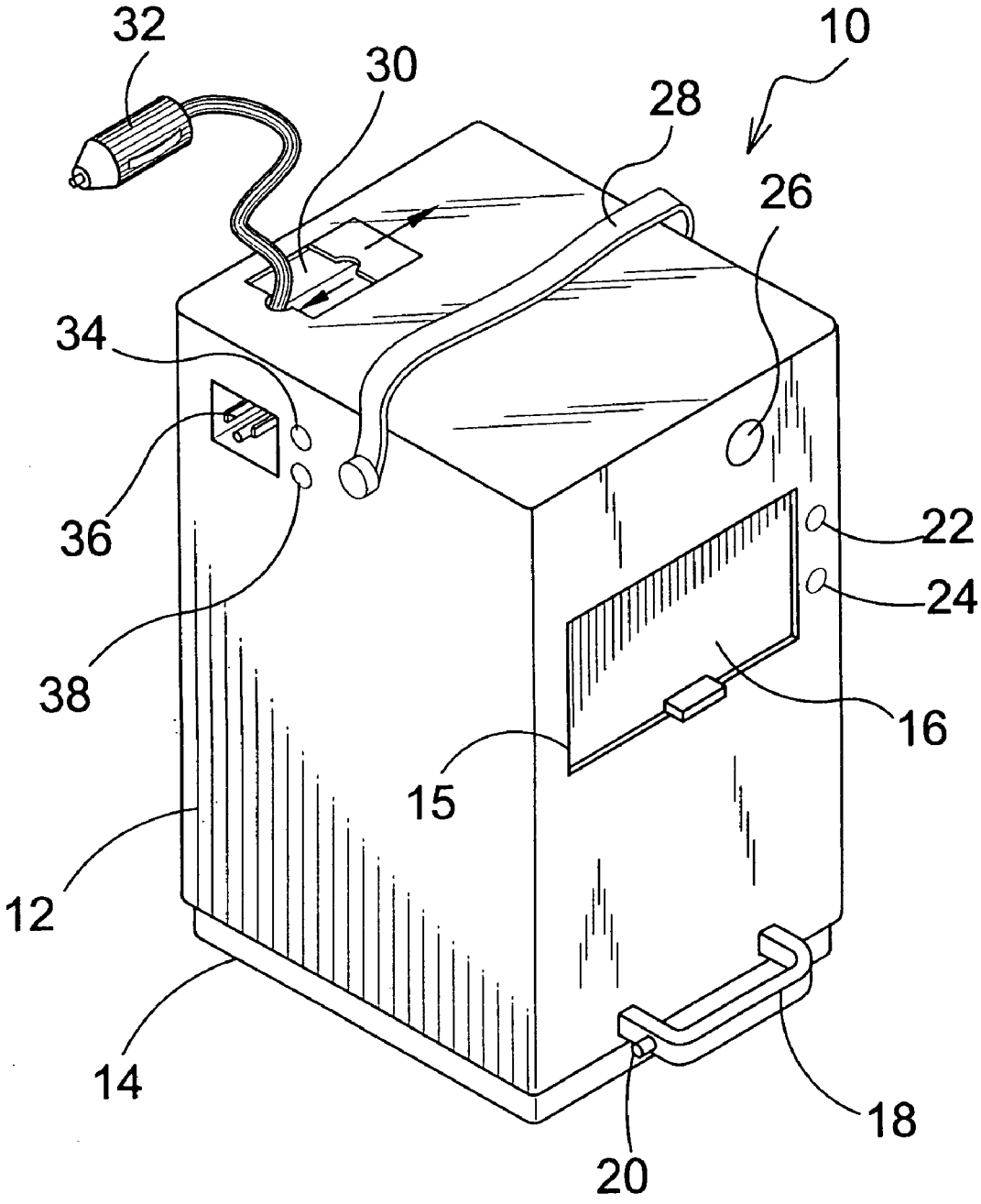
FIG. 3 is a perspective view of the portable trash compactor of the present invention.
Figure 4:
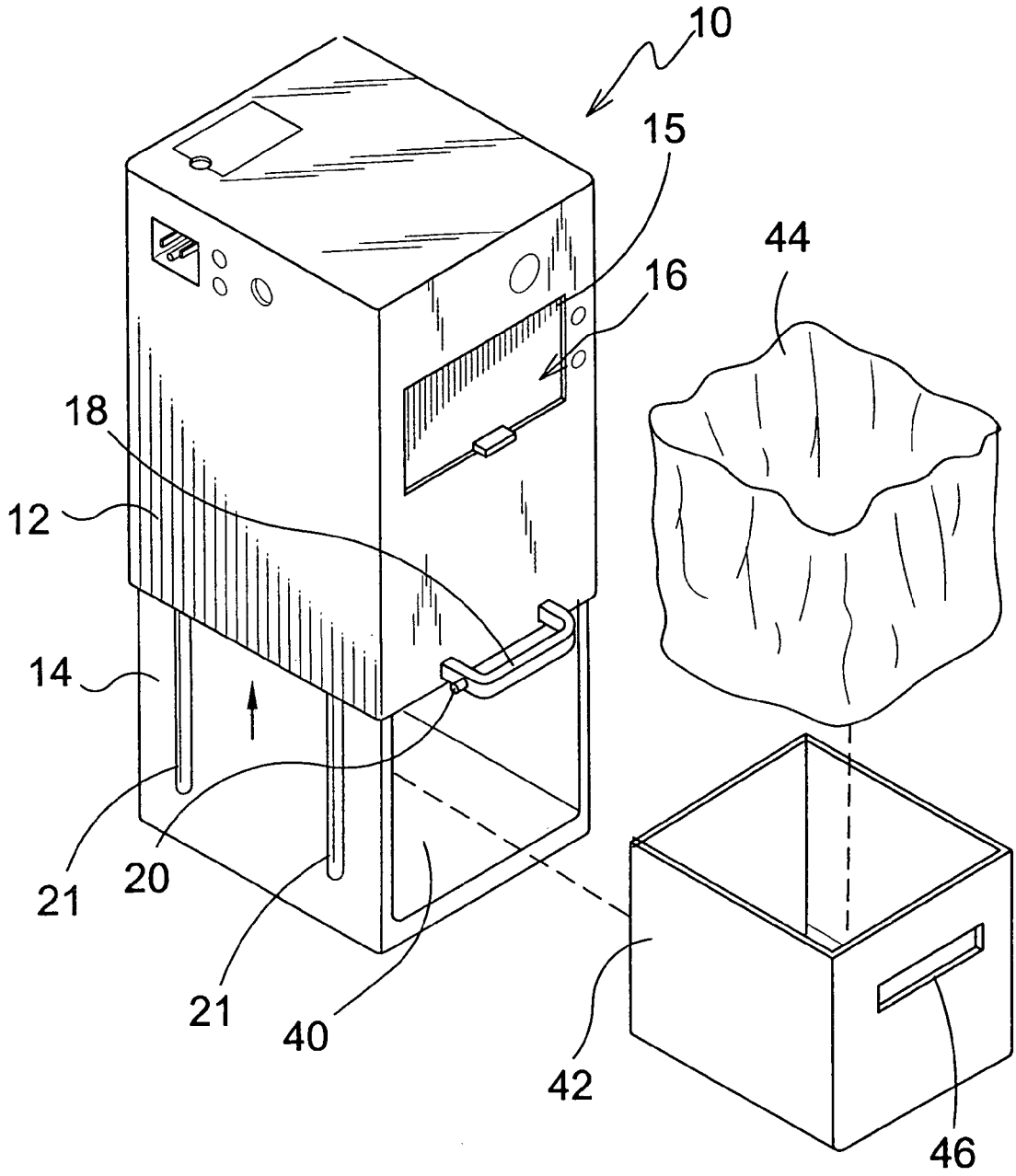
FIG. 4 is an exploded view of the portable trash compactor of the present invention.

FIG. 3 is a perspective view of the portable trash compactor of the present invention. The portable trash compactor 10 includes an outer housing 12 and an inner housing 14. The inner housing 14 fits within the outer housing 12 and the outer housing is sliable along a track 21 extending along the height of the inner housing 14 in order to provide access to a compartment 40 as shown in FIG. 4 of the inner housing 14. A lifting handle 18 including a lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. As shown in FIG. 4, positioned within the compartment 40 of the inner housing 14 is a refuse bin 42. The refuse bin 42 is substantially the same size as the compartment 40 if the inner housing 14. A reusable refuse bag 44 may be positioned within the refuse bin 42 for receiving refuse 50 therein.

The outer housing 12 further includes a recess 15 extending through a front side thereof. An access door 16 of substantially the same size and shape of the recess 15 is hingedly connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes an operation button 26 for selectively operating the portable trash compactor 10 of the present invention. Operation of the portable trash compactor will be discussed hereinafter with specific reference to FIGS. 5 and 6.

The portable trash compactor 10 further includes a detachable handle 28 for easily transporting thereof. The detachable handle 28 is connected to the outer housing 12 via at least one of a snap and button. The detachable handle 28 is preferably positioned on a top side of the outer housing 12. However, the detachable handle 28 may be positioned on any side of the portable trash compactor 10 of the present invention so long as it provides for easy carrying and transport of the portable trash compactor 10.

Figure 5:
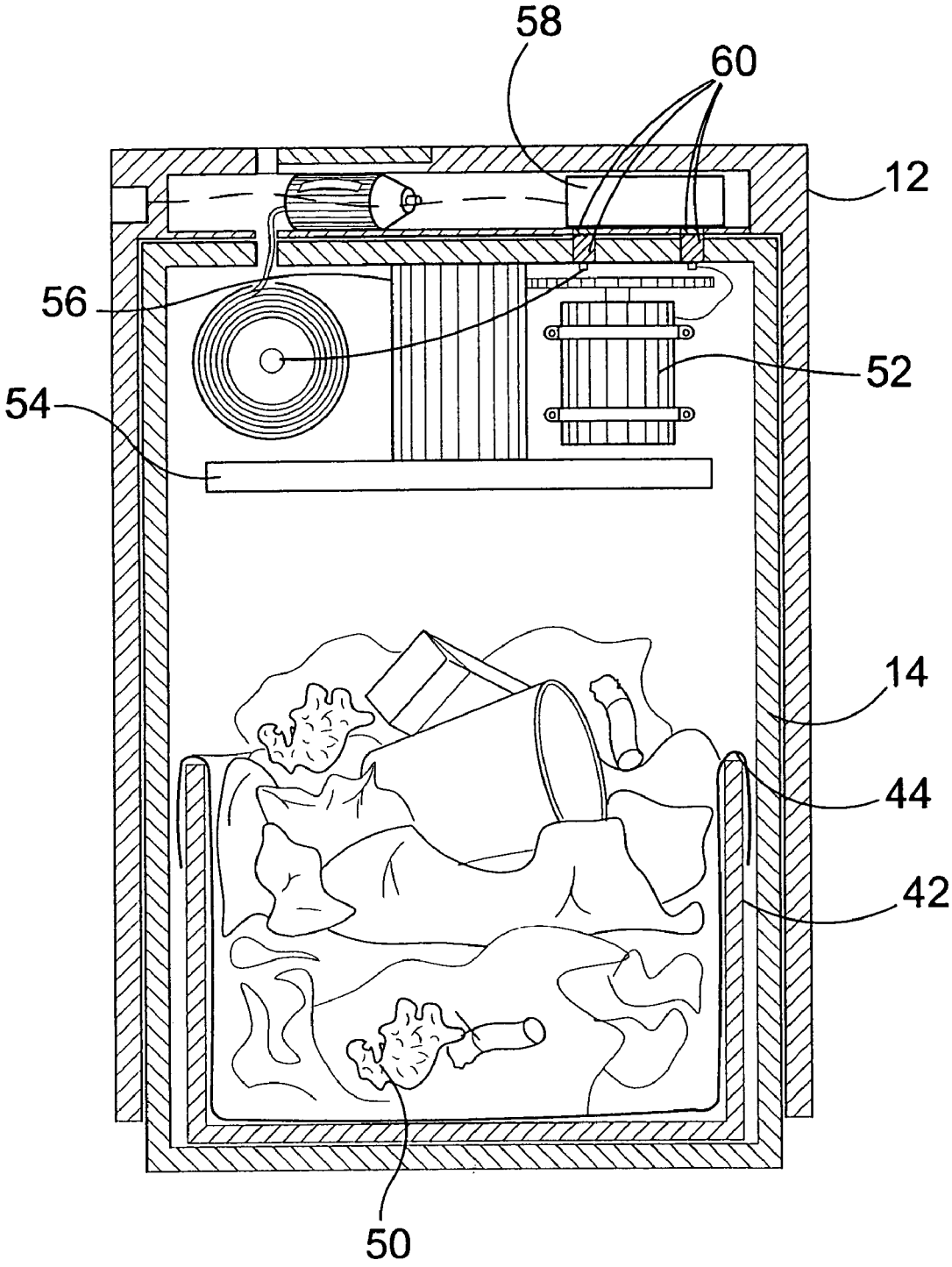
FIG. 5 is a cross-sectional front view of the portable trash compactor of the present invention in use.
Figure 6:
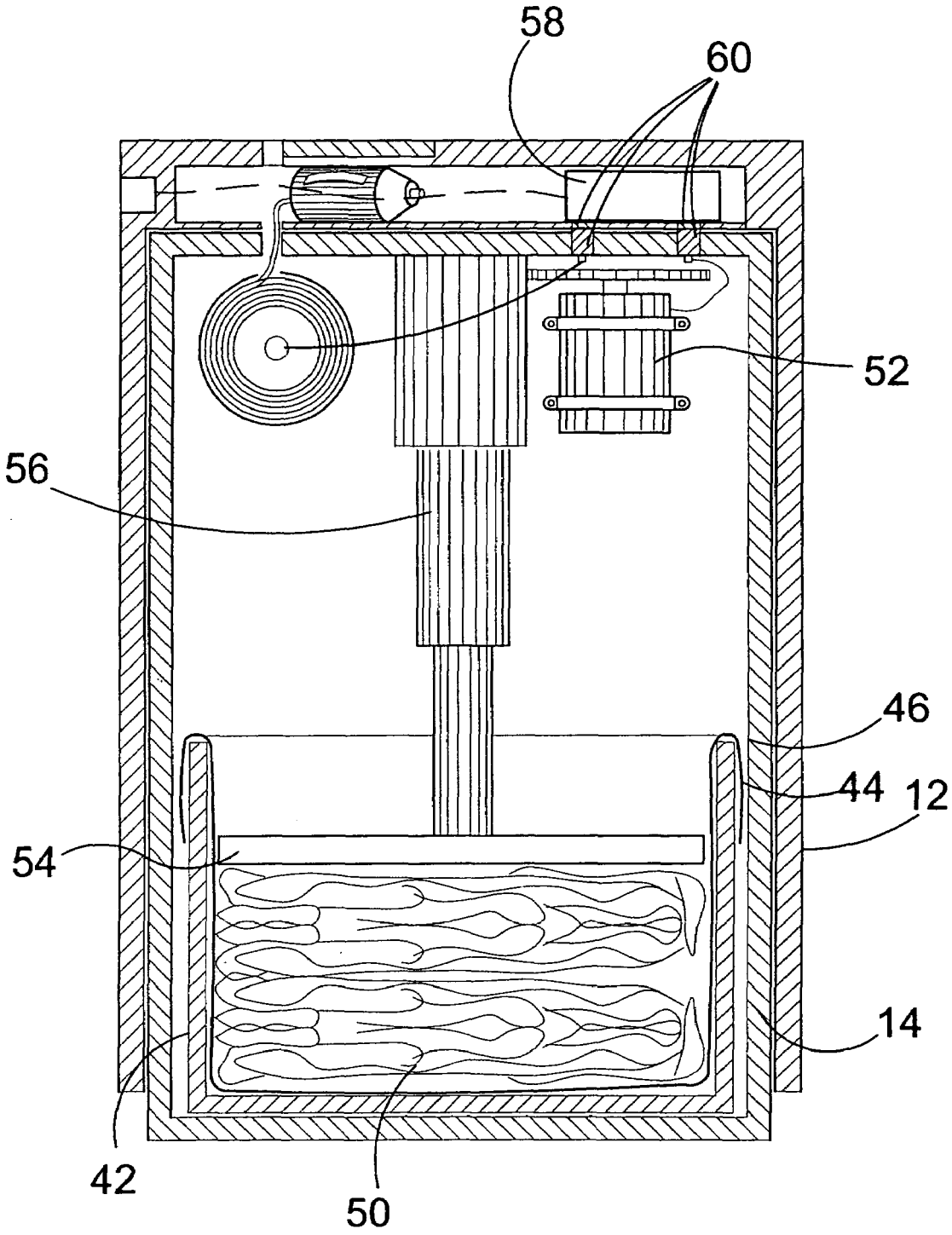
FIG. 6 is a cross-sectional front view of the portable trash compactor of the present invention in use.

The portable trash compactor 10 is powered by at least one of an external power source and an internal power source. The external power source is at least one of an AC power source or a DC power source. The outer housing 12 includes a power cord compartment 30 for storing a retractable power cord 32. The retractable power cord 32 is selectively connectable to at least one of an AC and DC power source. Preferably, the retractable power cord 32 is an adapter for receipt by a cigarette lighter of a vehicle. However, the retractable power cord 32 can selectively connect the portable trash compactor 10 to any external power source. Additionally, a power connection port 36 is positioned on a side of the outer housing 12. The power connection port 36 is able to receive a power cord (not shown) for connecting the portable trash compactor 10 to an external power source. The portable trash compactor 10 may include a rechargeable battery 58 as shown in FIGS. 5 and 6 for providing power thereto. The rechargeable battery 58 is recharged upon the portable trash compactor 10 being connected to an external power source.

The portable trash compactor 10 also includes a first indication light 22, second indication light 24, third indication light 34 and fourth indication light 38. The number of indication lights is described for purposes of example only and the portable trash compactor 10 may include any number of indication lights. The indication lights 22, 24, 34 and 38 indicated various functions being performed by the portable trash compactor 10. Preferably, the first indication light 22 signifies that the refuse bin 42 is filled to capacity with refuse 50 thus signaling a user to begin compacting. The second indication light 24 may indicate that the compacting function is either in progress or that it is safe to access the compartment 40 of the inner housing 14. This may be accomplished by having the second indication light illuminate a first color when the compactor 10 is compacting the refuse and illuminate a second different color when it is safe to retrieve the compacted refuse. It is also preferable that the third and fourth indication lights 34 and 38, respectively, indicate the level of power stored within the rechargeable power source 58. The third indication light 34 is illuminated when the rechargeable power source is at full capacity whereas the fourth indication light is illuminated when the level of power stored within the rechargeable power source falls below a threshold value. The indications given by the indication lights 22, 24, 34 and 38 are described for purposes of example only and the indication light can be caused to indication any function performed by the portable trash compactor 10 of the present invention.

FIG. 4 is an exploded view of the portable trash compactor of the present invention. The portable trash compactor 10 includes an outer housing 12 and an inner housing 14. The inner housing 14 fits within the outer housing 12 and the outer housing is sliable along the track 21 extending along the height of the inner housing 14 in order to provide access to the compartment 40 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. Positioned within the compartment 40 of the inner housing 14 is a refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes an operation button 26 for selectively operating the portable trash compactor 10 of the present invention. Operation of the portable trash compactor will be discussed hereinafter with specific reference to FIGS. 5 and 6.

FIG. 5 is a cross-sectional front view of the portable trash compactor of the present invention in use. The portable trash compactor 10 includes the outer housing 12 and the inner housing 14. The inner housing 14 fits within the outer housing 12 and the outer housing is sliable along the track 21 extending along the height of the inner housing 14 in order to provide access to the compartment 40 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. Positioned within the compartment 40 of the inner housing 14 is the refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is hingedly connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes the operation button 26 for selectively operating the portable trash compactor 10 of the present invention.

As shown in FIG. 5, the refuse 50 in the refuse bin 42 is ready to be compacted. A compacting mechanism is position on an inner side of the outer housing 12 at an end opposite the inner housing 14. The compacting mechanism includes a motor 52 connected to a drive mechanism 56. The motor 52 selectively controls the operation of the drive mechanism 56. A ram 54 is connected to an end of the drive mechanism 56. Upon activation of the motor 52, the drive mechanism 56 is caused to extend in a direction towards the refuse 50 within the refuse bag 44 positioned within the refuse bin 42. Upon extending the drive mechanism 56 the ram exerts pressure on the refuse 50 and caused the refuse to be compacted. A pressure sensor detects the amount of pressure exerted on the refuse 50 and, upon a predetermined amount of pressure being exerted thereon, the sensor signals the motor 52 to cause the drive member 56 to retract in a direction opposite the refuse 50. Thereafter, a user can selectively press the lock release button 20 on the handle 18 and slide the outer housing 12 along the track 21 of the inner housing 14 and remove the compacted refuse 50 from the refuse bin 42.

FIG. 6 is a cross-sectional front view of the portable trash compactor of the present invention in use. The portable trash compactor 10 includes the outer housing 12 and the inner housing 14. The inner housing 14 fits within the outer housing 12 and the outer housing is sliable along the track 21 extending along the height of the inner housing 14 in order to provide access to the compartment 40 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. Positioned within the compartment 40 of the inner housing 14 is the refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is hingedly connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes the operation button 26 for selectively operating the portable trash compactor 10 of the present invention.

A compacting mechanism is position on an inner side of the outer housing 12 at an end opposite the inner housing 14. The compacting mechanism includes a motor 52 connected to a drive mechanism 56. The motor 52 selectively controls the operation of the drive mechanism 56. A ram 54 is connected to an end of the drive mechanism 56. Upon activation of the motor 52, the drive mechanism 56 is caused to extend in a direction towards the refuse 50 within the refuse bag 44 positioned within the refuse bin 42. Upon extending the drive mechanism 56 the ram exerts pressure on the refuse 50 and caused the refuse to be compacted. A pressure sensor detects the amount of pressure exerted on the refuse 50 and, upon a predetermined amount of pressure being exerted thereon, the sensor signals the motor 52 to cause the drive member 56 to retract in a direction opposite the refuse 50. Thereafter, a user can selectively press the lock release button 20 on the handle 18 and slide the outer housing 12 along the track 21 of the inner housing 14 and remove the compacted refuse 50 from the refuse bin 42. As shown in FIG. 6, the refuse 50 has been fully compacted and is ready for removal from the portable trash compactor 10.

Figure 7:
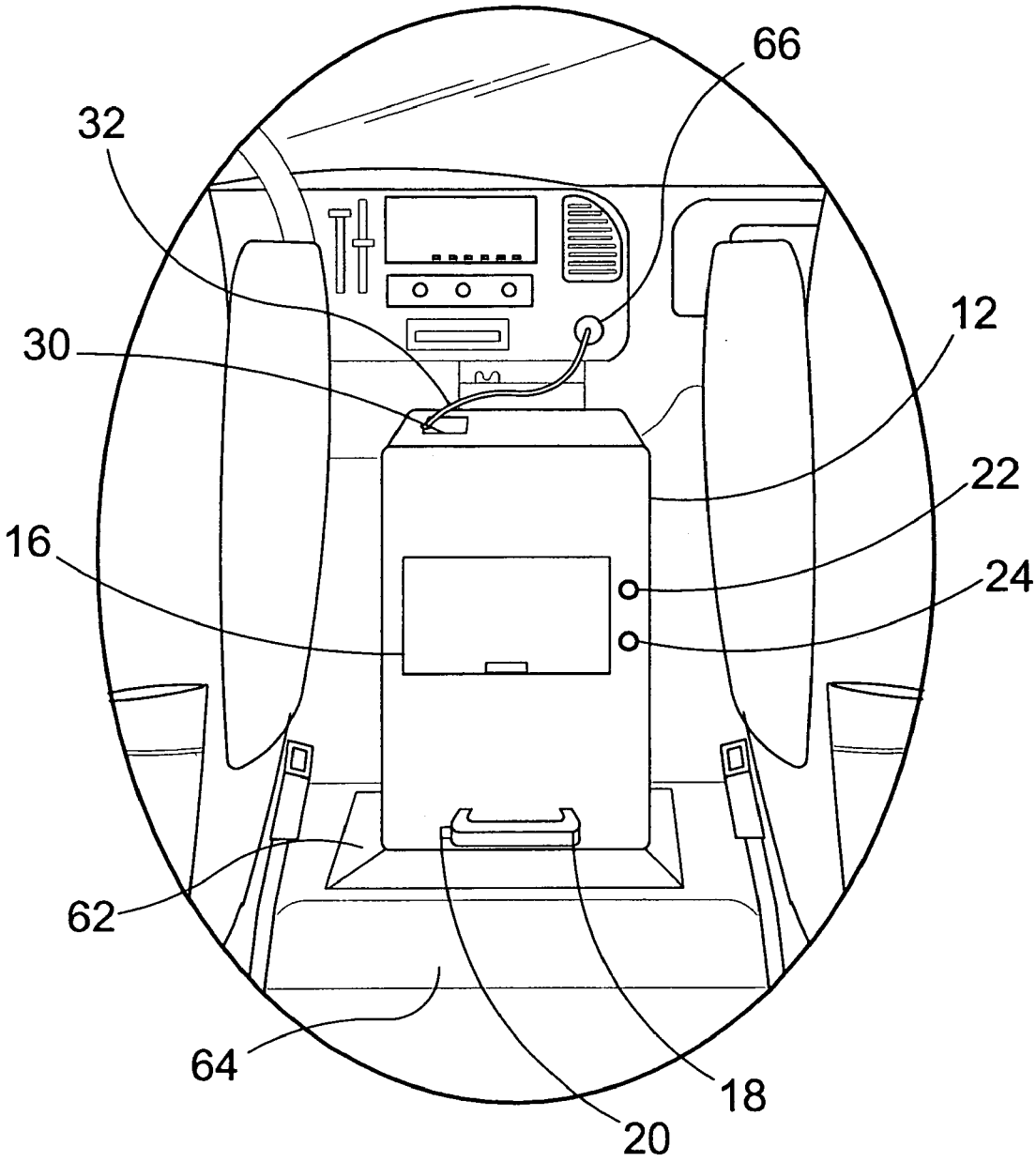
FIG. 7 is an illustrative view of the portable trash compactor of the present invention installed in the console of a vehicle.

FIG. 7 is an illustrative view of the portable trash compactor of the present invention installed in the console of a vehicle. The portable trash compactor 10 includes the outer housing 12 and the inner housing 14. The inner housing 14 fits within the outer housing 12 and the outer housing is sliable along the track 21 extending along the height of the inner housing 14 in order to provide access to the compartment 40 as shown in FIG. 4 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. As shown in FIG. 4, positioned within the compartment 40 of the inner housing 14 is the refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes an operation button 26 for selectively operating the portable trash compactor 10 of the present invention. Operation of the portable trash compactor is discussed hereinabove with specific reference to FIGS. 5 and 6.

The portable trash compactor 10 further includes the detachable handle 28 for easily transporting thereof. The detachable handle 28 is connected to the outer housing 12 via at least one of a snap and button. The detachable handle 28 is preferably positioned on a top side of the outer housing 12. However, the detachable handle 28 may be positioned on any side of the portable trash compactor 10 of the present invention so long as it provides for easy carrying and transport of the portable trash compactor 10.

The portable trash compactor 10 is powered by at least one of an external power source and an internal power source. The external power source is at least one of an AC power source or a DC power source. The outer housing 12 includes a power cord compartment 30 for storing a retractable power cord 32. The retractable power cord 32 is selectively connectable to at least one of an AC and DC power source. Preferably, the retractable power cord 32 is an adapter for receipt by a cigarette lighter of a vehicle. However, the retractable power cord 32 can selectively connect the portable trash compactor 10 to any external power source. Additionally, a power connection port 36 is positioned on a side of the outer housing 12. The power connection port 36 is able to receive a power cord (not shown) for connecting the portable trash compactor 10 to an external power source. The portable trash compactor 10 may include a rechargeable battery 58 as shown in FIGS. 5 and 6 for providing power thereto. The rechargeable battery 58 is recharged upon the portable trash compactor 10 being connected to an external power source.

The portable trash compactor 10 also includes a first indication light 22, second indication light 24, third indication light 34 and fourth indication light 38. The number of indication lights is described for purposes of example only and the portable trash compactor 10 may include any number of indication lights. The indication lights 22, 24, 34 and 38 indicated various functions being performed by the portable trash compactor 10. Preferably, the first indication light 22 signifies that the refuse bin 42 is filled to capacity with refuse 50 thus signaling a user to begin compacting. The second indication light 24 may indicate that the compacting function is either in progress or that it is safe to access the compartment 40 of the inner housing 14. This may be accomplished by having the second indication light illuminate a first color when the compactor 10 is compacting the refuse and illuminate a second different color when it is safe to retrieve the compacted refuse. It is also preferable that the third and fourth indication lights 34 and 38, respectively, indicate the level of power stored within the rechargeable power source 58. The third indication light 34 is illuminated when the rechargeable power source is at full capacity whereas the fourth indication light is illuminated when the level of power stored within the rechargeable power source falls below a threshold value. The indications given by the indication lights 22, 24, 34 and 38 are described for purposes of example only and the indication light can be caused to indication any function performed by the portable trash compactor 10 of the present invention.

FIG. 7 shows the portable trash compactor 10 of the present invention on a console 64 between two chairs in a vehicle. A base 64 is connected to the console 64 thereby allowing the user to selectively secure and remove the portable trash compactor 10 as needed. When the portable trash compactor 10 is used in a vehicle, the retractable power cord 32 is used to selectively connect the portable trash compactor 10 to the external power source 66 of the vehicle. As shown herein, the external power source 66 is the cigarette lighter which provides a 12 V DC power source for providing power to and operating the portable trash compactor 10.

Figure 8:
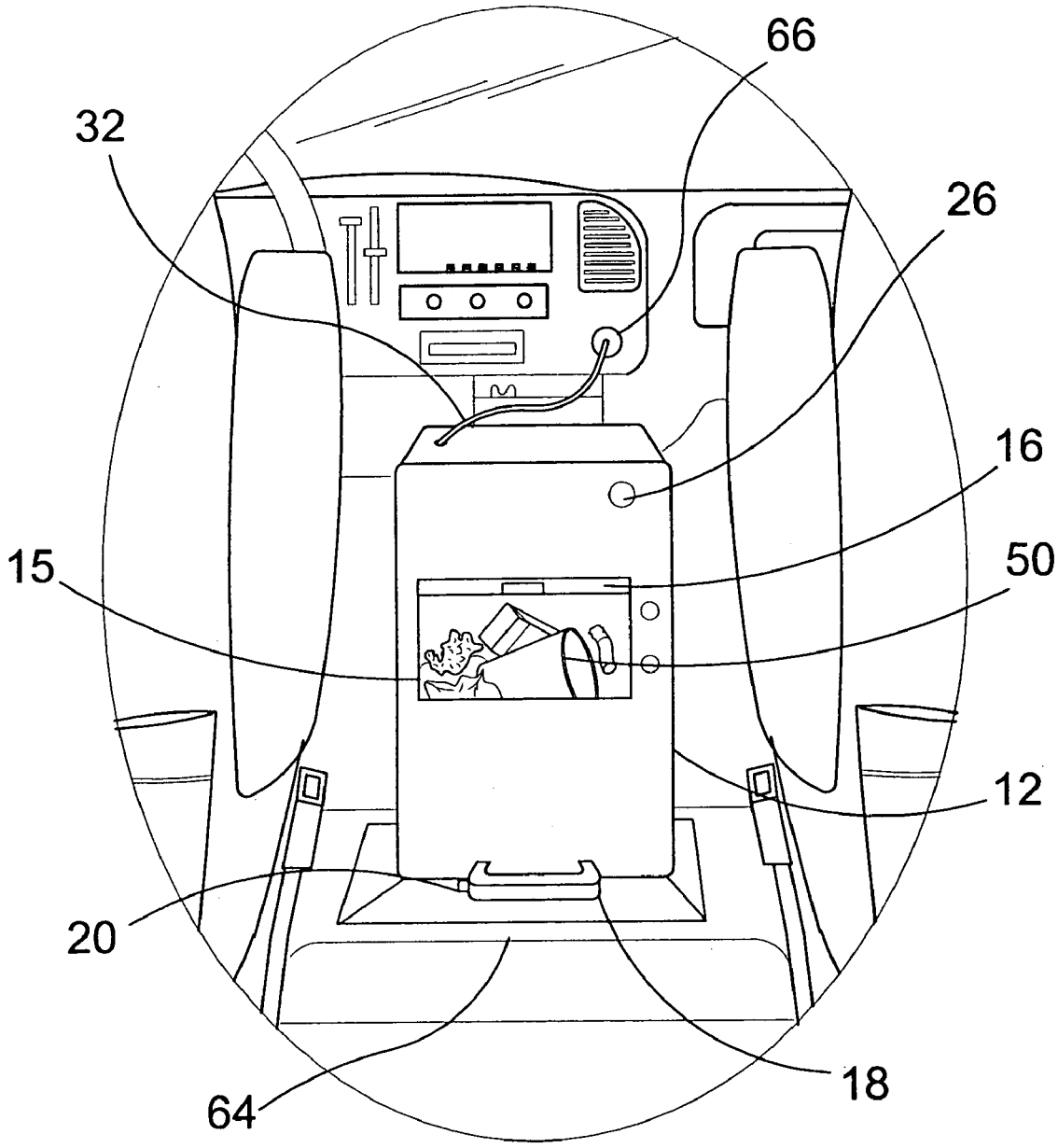
FIG. 8 is an illustrative view of the portable trash compactor of the present invention installed in the console of a vehicle.

FIG. 8 is an illustrative view of the portable trash compactor of the present invention installed in the console of a vehicle. The portable trash compactor 10 includes the outer housing 12 and the inner housing 14. The inner housing 14 fits within the outer housing 12 and the outer housing is sliable along the track 21 extending along the height of the inner housing 14 in order to provide access to the compartment 40 as shown in FIG. 4 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. As shown in FIG. 4, positioned within the compartment 40 of the inner housing 14 is the refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes an operation button 26 for selectively operating the portable trash compactor 10 of the present invention. Operation of the portable trash compactor is discussed hereinabove with specific reference to FIGS. 5 and 6.

The portable trash compactor 10 further includes the detachable handle 28 for easily transporting thereof. The detachable handle 28 is connected to the outer housing 12 via at least one of a snap and button. The detachable handle 28 is preferably positioned on a top side of the outer housing 12. However, the detachable handle 28 may be positioned on any side of the portable trash compactor 10 of the present invention so long as it provides for easy carrying and transport of the portable trash compactor 10.

The portable trash compactor 10 is powered by at least one of an external power source and an internal power source. The external power source is at least one of an AC power source or a DC power source. The outer housing 12 includes a power cord compartment 30 for storing a retractable power cord 32. The retractable power cord 32 is selectively connectable to at least one of an AC and DC power source. Preferably, the retractable power cord 32 is an adapter for receipt by a cigarette lighter of a vehicle. However, the retractable power cord 32 can selectively connect the portable trash compactor 10 to any external power source. Additionally, a power connection port 36 is positioned on a side of the outer housing 12. The power connection port 36 is able to receive a power cord (not shown) for connecting the portable trash compactor 10 to an external power source. The portable trash compactor 10 may include a rechargeable battery 58 as shown in FIGS. 5 and 6 for providing power thereto. The rechargeable battery 58 is recharged upon the portable trash compactor 10 being connected to an external power source.

The portable trash compactor 10 also includes a first indication light 22, second indication light 24, third indication light 34 and fourth indication light 38. The number of indication lights is described for purposes of example only and the portable trash compactor 10 may include any number of indication lights. The indication lights 22, 24, 34 and 38 indicated various functions being performed by the portable trash compactor 10. Preferably, the first indication light 22 signifies that the refuse bin 42 is filled to capacity with refuse 50 thus signaling a user to begin compacting. The second indication light 24 may indicate that the compacting function is either in progress or that it is safe to access the compartment 40 of the inner housing 14. This may be accomplished by having the second indication light illuminate a first color when the compactor 10 is compacting the refuse and illuminate a second different color when it is safe to retrieve the compacted refuse. It is also preferable that the third and fourth indication lights 34 and 38, respectively, indicate the level of power stored within the rechargeable power source 58. The third indication light 34 is illuminated when the rechargeable power source is at full capacity whereas the fourth indication light is illuminated when the level of power stored within the rechargeable power source falls below a threshold value. The indications given by the indication lights 22, 24, 34 and 38 are described for purposes of example only and the indication light can be caused to indication any function performed by the portable trash compactor 10 of the present invention.

FIG. 8 shows the portable trash compactor 10 of the present invention on a console 64 between two chairs in a vehicle. A base 64 is connected to the console 64 thereby allowing the user to selectively secure and remove the portable trash compactor 10 as needed. When the portable trash compactor 10 is used in a vehicle, the retractable power cord 32 is used to selectively connect the portable trash compactor 10 to the external power source 66 of the vehicle. As shown herein, the external power source 66 is the cigarette lighter which provides a 12 V DC power source for providing power to and operating the portable trash compactor 10. The access door 16 is shown open thereby allowing the user to dispose of refuse for later compacting thereof.

Figure 9:
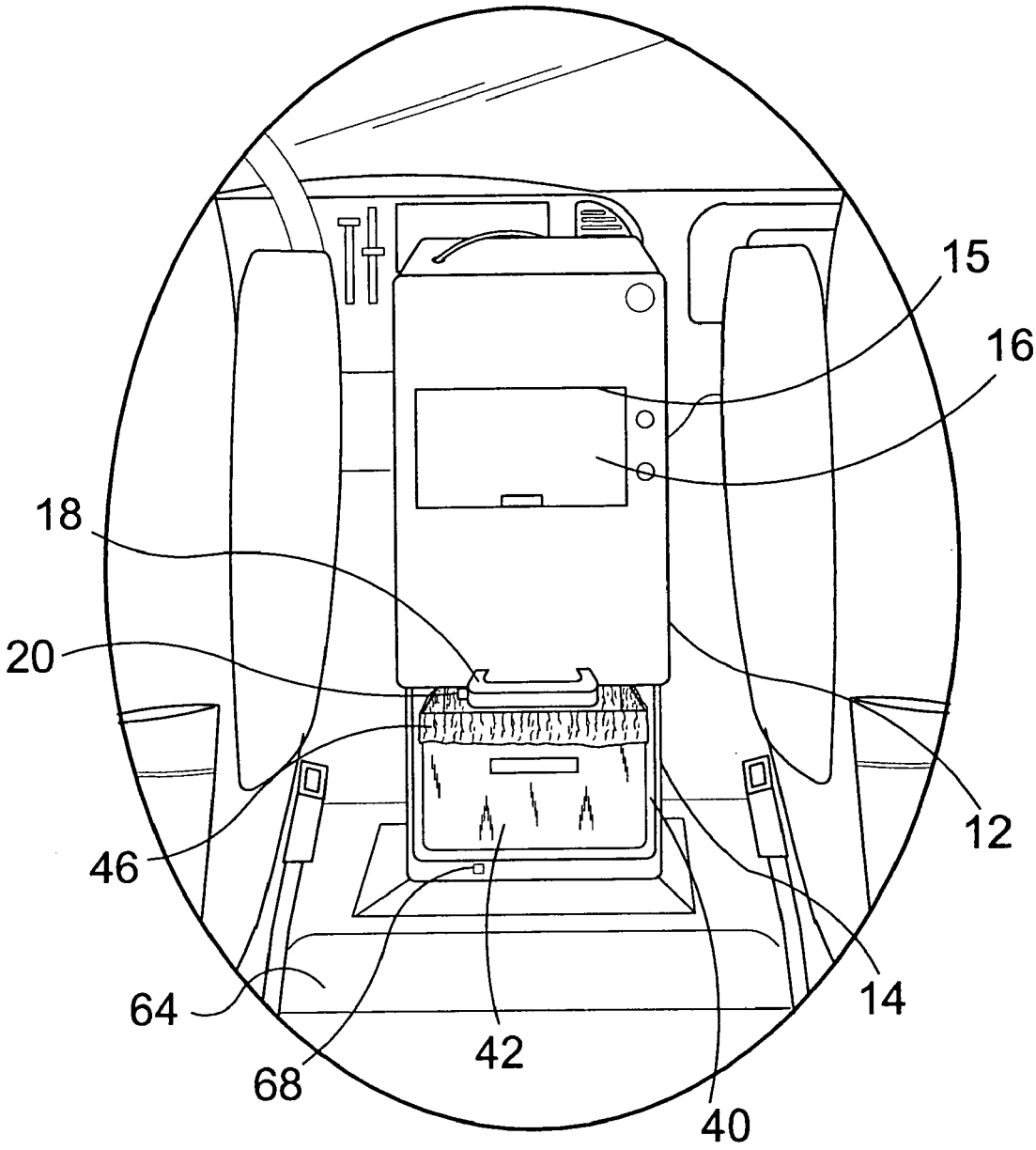
FIG. 9 is an illustrative view of the trash bin of the portable trash compactor of the present invention installed in the console of a vehicle.

FIG. 9 is an illustrative view of the trash bin of the portable trash compactor of the present invention installed in the console of a vehicle. The portable trash compactor 10 includes the outer housing 12 and the inner housing 14. The inner housing 14 fits within the outer housing 12 and the outer housing is sliable along the track 21 extending along the height of the inner housing 14 in order to provide access to the compartment 40 as shown in FIG. 4 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. As shown in FIG. 4, positioned within the compartment 40 of the inner housing 14 is the refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes an operation button 26 for selectively operating the portable trash compactor 10 of the present invention. Operation of the portable trash compactor is discussed hereinabove with specific reference to FIGS. 5 and 6.

The portable trash compactor 10 further includes the detachable handle 28 for easily transporting thereof. The detachable handle 28 is connected to the outer housing 12 via at least one of a snap and button. The detachable handle 28 is preferably positioned on a top side of the outer housing 12. However, the detachable handle 28 may be positioned on any side of the portable trash compactor 10 of the present invention so long as it provides for easy carrying and transport of the portable trash compactor 10.

The portable trash compactor 10 is powered by at least one of an external power source and an internal power source. The external power source is at least one of an AC power source or a DC power source. The outer housing 12 includes a power cord compartment 30 for storing a retractable power cord 32. The retractable power cord 32 is selectively connectable to at least one of an AC and DC power source. Preferably, the retractable power cord 32 is an adapter for receipt by a cigarette lighter of a vehicle. However, the retractable power cord 32 can selectively connect the portable trash compactor 10 to any external power source. Additionally, a power connection port 36 is positioned on a side of the outer housing 12. The power connection port 36 is able to receive a power cord (not shown) for connecting the portable trash compactor 10 to an external power source. The portable trash compactor 10 may include a rechargeable battery 58 as shown in FIGS. 5 and 6 for providing power thereto. The rechargeable battery 58 is recharged upon the portable trash compactor 10 being connected to an external power source.

The portable trash compactor 10 also includes a first indication light 22, second indication light 24, third indication light 34 and fourth indication light 38. The number of indication lights is described for purposes of example only and the portable trash compactor 10 may include any number of indication lights. The indication lights 22, 24, 34 and 38 indicated various functions being performed by the portable trash compactor 10. Preferably, the first indication light 22 signifies that the refuse bin 42 is filled to capacity with refuse 50 thus signaling a user to begin compacting. The second indication light 24 may indicate that the compacting function is either in progress or that it is safe to access the compartment 40 of the inner housing 14. This may be accomplished by having the second indication light illuminate a first color when the compactor 10 is compacting the refuse and illuminate a second different color when it is safe to retrieve the compacted refuse. It is also preferable that the third and fourth indication lights 34 and 38, respectively, indicate the level of power stored within the rechargeable power source 58. The third indication light 34 is illuminated when the rechargeable power source is at full capacity whereas the fourth indication light is illuminated when the level of power stored within the rechargeable power source falls below a threshold value. The indications given by the indication lights 22, 24, 34 and 38 are described for purposes of example only and the indication light can be caused to indication any function performed by the portable trash compactor 10 of the present invention.

FIG. 9 shows the portable trash compactor 10 of the present invention on a console 64 between two chairs in a vehicle. A base 64 is connected to the console 64 thereby allowing the user to selectively secure and remove the portable trash compactor 10 as needed. When the portable trash compactor 10 is used in a vehicle, the retractable power cord 32 is used to selectively connect the portable trash compactor 10 to the external power source 66 of the vehicle. As shown herein, the external power source 66 is the cigarette lighter which provides a 12 V DC power source for providing power to and operating the portable trash compactor 10. As seen in this Figure, the refuse contained within the refuse bin 42 has been compacted and the lock release button 20 has be depressed thereby causing the outer housing 12 to be disengaged from the inner housing 14 and slidable along the tracks 21 in order to all easy access to remove the compacted refuse.

FIG. 9 is an illustrative view of the present invention in use. The user must slide the outer housing up along the lower housing in order to expose the refuse container to change the refuse bag. This is accomplished by depressing the housing lock release and raising the lift handle until the housing lock release secures the outer housing in the raised position. The drive mechanism is disabled until the outer housing is lowered and the housing lock sensor detects a secure closed condition.

Figure 10:
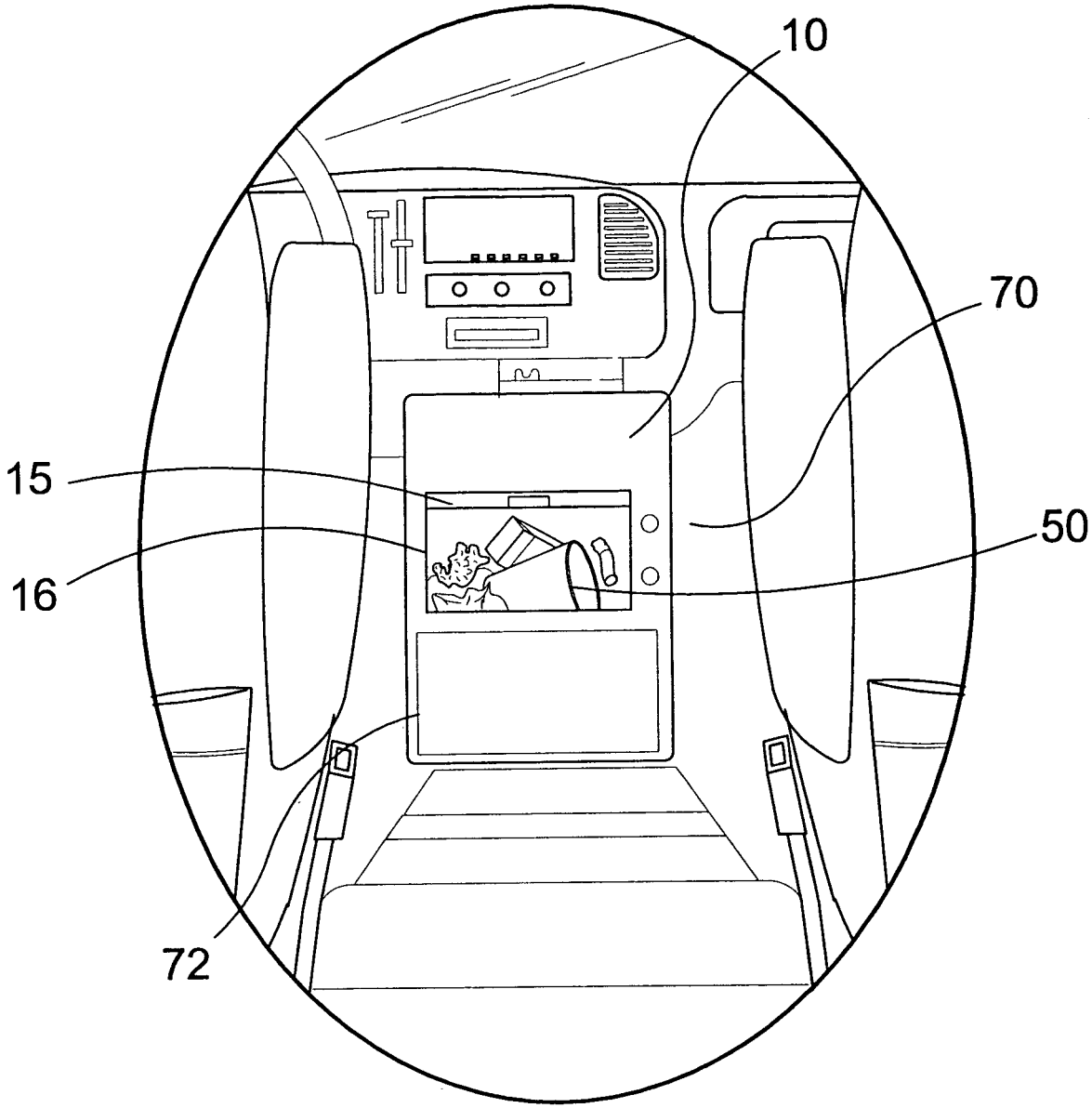
FIG. 10 is an illustrative view of the portable trash compactor of the present invention installed in the dashboard of a vehicle.

FIG. 10 is an illustrative view of the portable trash compactor of the present invention installed in the dashboard of a vehicle. The portable trash compactor 10 includes the outer housing 12 and the inner housing 14. The inner housing 14 fits within the outer housing 12 and the outer housing is sliable along the track 21 extending along the height of the inner housing 14 in order to provide access to the compartment 40 as shown in FIG. 4 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. As shown in FIG. 4, positioned within the compartment 40 of the inner housing 14 is the refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes an operation button 26 for selectively operating the portable trash compactor 10 of the present invention. Operation of the portable trash compactor is discussed hereinabove with specific reference to FIGS. 5 and 6.

The portable trash compactor 10 further includes the detachable handle 28 for easily transporting thereof. The detachable handle 28 is connected to the outer housing 12 via at least one of a snap and button. The detachable handle 28 is preferably positioned on a top side of the outer housing 12. However, the detachable handle 28 may be positioned on any side of the portable trash compactor 10 of the present invention so long as it provides for easy carrying and transport of the portable trash compactor 10.

The portable trash compactor 10 is powered by at least one of an external power source and an internal power source. The external power source is at least one of an AC power source or a DC power source. The outer housing 12 includes a power cord compartment 30 for storing a retractable power cord 32. The retractable power cord 32 is selectively connectable to at least one of an AC and DC power source. Preferably, the retractable power cord 32 is an adapter for receipt by a cigarette lighter of a vehicle. However, the retractable power cord 32 can selectively connect the portable trash compactor 10 to any external power source. Additionally, a power connection port 36 is positioned on a side of the outer housing 12. The power connection port 36 is able to receive a power cord (not shown) for connecting the portable trash compactor 10 to an external power source. The portable trash compactor 10 may include a rechargeable battery 58 as shown in FIGS. 5 and 6 for providing power thereto. The rechargeable battery 58 is recharged upon the portable trash compactor 10 being connected to an external power source.

The portable trash compactor 10 also includes a first indication light 22, second indication light 24, third indication light 34 and fourth indication light 38. The number of indication lights is described for purposes of example only and the portable trash compactor 10 may include any number of indication lights. The indication lights 22, 24, 34 and 38 indicated various functions being performed by the portable trash compactor 10. Preferably, the first indication light 22 signifies that the refuse bin 42 is filled to capacity with refuse 50 thus signaling a user to begin compacting. The second indication light 24 may indicate that the compacting function is either in progress or that it is safe to access the compartment 40 of the inner housing 14. This may be accomplished by having the second indication light illuminate a first color when the compactor 10 is compacting the refuse and illuminate a second different color when it is safe to retrieve the compacted refuse. It is also preferable that the third and fourth indication lights 34 and 38, respectively, indicate the level of power stored within the rechargeable power source 58. The third indication light 34 is illuminated when the rechargeable power source is at full capacity whereas the fourth indication light is illuminated when the level of power stored within the rechargeable power source falls below a threshold value. The indications given by the indication lights 22, 24, 34 and 38 are described for purposes of example only and the indication light can be caused to indication any function performed by the portable trash compactor 10 of the present invention.

The portable trash compactor 10 is shown installed in the dashboard 70 of a vehicle. The method by which the inner compartment is accessed in this embodiment differs from that described above. The dashboard version includes a hinged chamber door 72, similar to the access door 16, for gaining access to the refuse in the refuse bin. After the refuse has been compacted, the user selectively opens the hinged chamber door 72 and removes the refuse bin from the inner compartment 40. Upon disposing of the compacted refuse, the hinged chamber door 72 is opened once again and the refuse bin 42 is replaced within the compartment 40 if the inner housing 14. Thereafter, the refuse bin is able to receive additional refuse.

Figure 11:
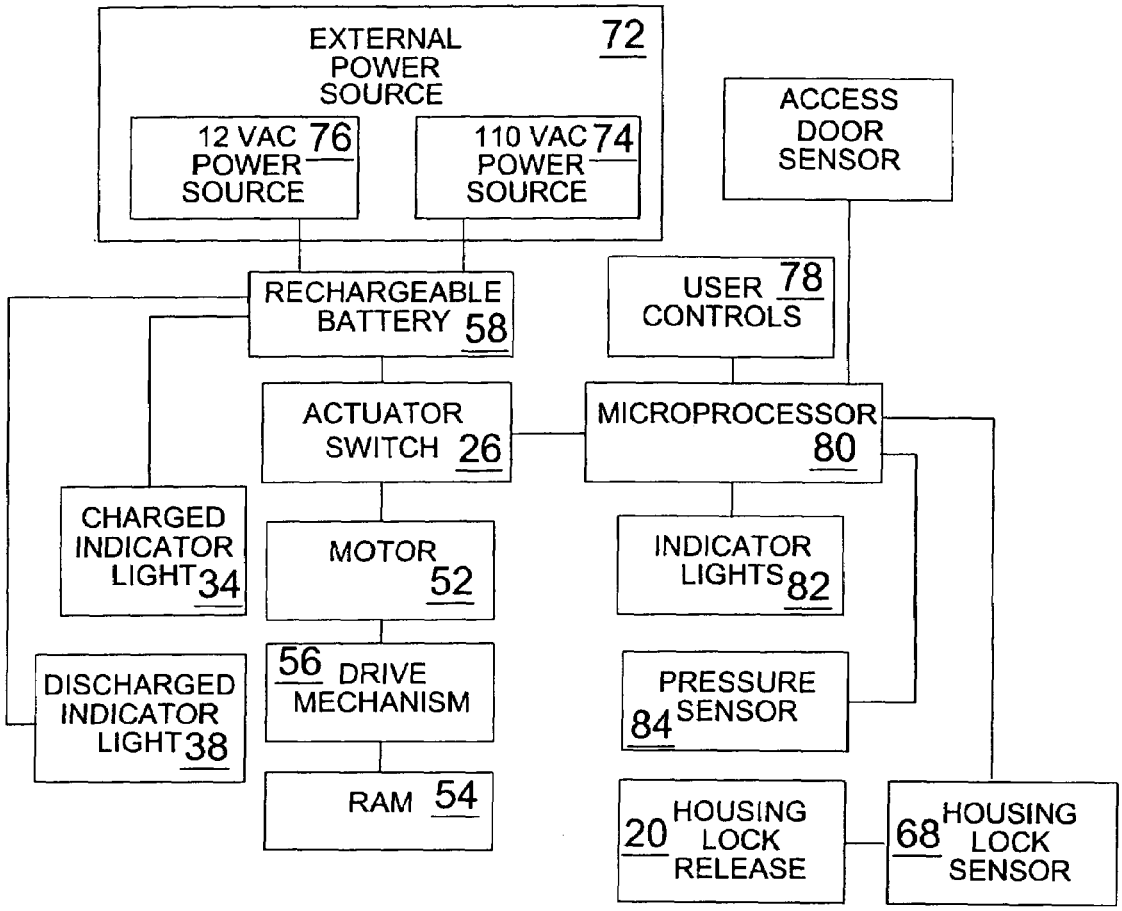
FIG. 11 is a block diagram of the portable trash compactor of the present invention.

FIG. 11 is a block diagram of the portable trash compactor of the present invention. The trash compactor includes a processor 80. The processor 80 is connected to indication lights 82, a pressure sensor 84, a housing lock sensor 86, access door sensor, the operation button 26 and the motor 52. Also the rechargeable power source 58 is connected between the processor 80 and the external power source 66. Both the third indication light 34 and the fourth indication light 38 are connected to the rechargeable power source 58 for indicating the amount of power remaining in the rechargeable power source 58. The drive mechanism 56 is connected to the motor 52 and the ram 54.

The housing lock sensor 68 determines whether the outer housing 12 is in a first open position or in a second closed position. Upon detecting the outer housing 12 is in an second closed position, the housing lock sensor signals the processor 80 to lock the housing lock thereby securing the outer housing 12 to the inner housing 14. When the outer housing 12 is in the second closed position, a user can selectively dispose of refuse through the access door 16. When the access door 16 is in an open position, the access door sensor 86 signals the processor 80 and prevents operation of the portable trash compactor 10. Upon the access door sensor 86 detecting that the access door 16 is in the closed position, the sensor 86 is disabled and operation of the device is permitted.

When a user desires to compact the refuse that has collected in the refuse bin 42, the user depresses the operation button 26. Thereafter, the processor signals the motor 52 to operate in a first direction thereby causing the drive member 56 to extend and cause the ram to exert pressure on the refuse in the refuse bin 42. The pressure sensor 84 determines the amount of pressure being exerted upon the refuse and upon the amount reaching a threshold value, the pressure sensor 84 signals the processor to cause the motor 52 to operate in a second direction thereby retracting the ram 54 and the drive member 56. Upon full retraction of the drive member 56, the processor signals the motor to stop operating and thus allowing the user to dispose of the compacted refuse.

If the portable trash compactor 10 is connected to an external power source 66, the processor causes the rechargeable power source to be charged. The external power source 66 may includes at least one of 110 V AC power source 74 and 12 V DC power source 76. Upon the rechargeable power source 58 reaching a predetermined level, the third indication light 34 is illuminated thus indicating that the rechargeable power source 58 is fully charged. If the power stored in the rechargeable power source falls below the same predetermined level, the fourth indication light is illuminated thus indicated that the rechargeable power source needs to be recharged.

Figure 12:
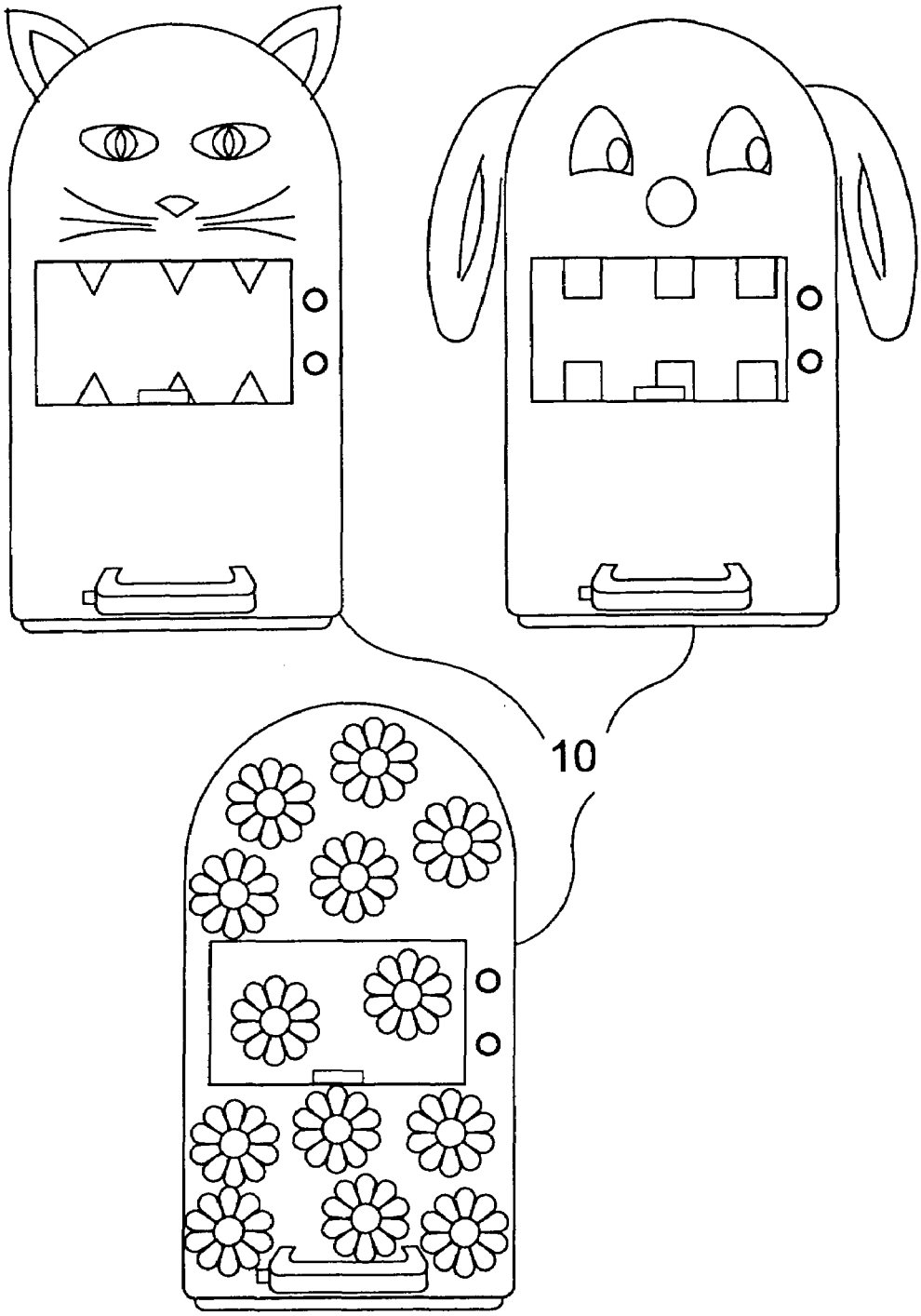
FIG. 12 is an illustrative view of the decorative designs for the portable trash compactor of the present invention.

FIG. 12 is an illustrative view of the decorative designs for the portable trash compactor of the present invention. The portable trash compactor 10 includes the outer housing 12 and the inner housing 14. The inner housing 14 fits within the outer housing 12 and the outer housing is sliable along the track 21 extending along the height of the inner housing 14 in order to provide access to the compartment 40 as shown in FIG. 4 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. As shown in FIG. 4, positioned within the compartment 40 of the inner housing 14 is the refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes an operation button 26 for selectively operating the portable trash compactor 10 of the present invention. Operation of the portable trash compactor is discussed hereinabove with specific reference to FIGS. 5 and 6.

The portable trash compactor 10 further includes the detachable handle 28 for easily transporting thereof. The detachable handle 28 is connected to the outer housing 12 via at least one of a snap and button. The detachable handle 28 is preferably positioned on a top side of the outer housing 12. However, the detachable handle 28 may be positioned on any side of the portable trash compactor 10 of the present invention so long as it provides for easy carrying and transport of the portable trash compactor 10.

The portable trash compactor 10 is powered by at least one of an external power source and an internal power source. The external power source is at least one of an AC power source or a DC power source. The outer housing 12 includes a power cord compartment 30 for storing a retractable power cord 32. The retractable power cord 32 is selectively connectable to at least one of an AC and DC power source. Preferably, the retractable power cord 32 is an adapter for receipt by a cigarette lighter of a vehicle. However, the retractable power cord 32 can selectively connect the portable trash compactor 10 to any external power source. Additionally, a power connection port 36 is positioned on a side of the outer housing 12. The power connection port 36 is able to receive a power cord (not shown) for connecting the portable trash compactor 10 to an external power source. The portable trash compactor 10 may include a rechargeable battery 58 as shown in FIGS. 5 and 6 for providing power thereto. The rechargeable battery 58 is recharged upon the portable trash compactor 10 being connected to an external power source.

The portable trash compactor 10 also includes a first indication light 22, second indication light 24, third indication light 34 and fourth indication light 38. The number of indication lights is described for purposes of example only and the portable trash compactor 10 may include any number of indication lights. The indication lights 22, 24, 34 and 38 indicated various functions being performed by the portable trash compactor 10. Preferably, the first indication light 22 signifies that the refuse bin 42 is filled to capacity with refuse 50 thus signaling a user to begin compacting. The second indication light 24 may indicate that the compacting function is either in progress or that it is safe to access the compartment 40 of the inner housing 14. This may be accomplished by having the second indication light illuminate a first color when the compactor 10 is compacting the refuse and illuminate a second different color when it is safe to retrieve the compacted refuse. It is also preferable that the third and fourth indication lights 34 and 38, respectively, indicate the level of power stored within the rechargeable power source 58. The third indication light 34 is illuminated when the rechargeable power source is at full capacity whereas the fourth indication light is illuminated when the level of power stored within the rechargeable power source falls below a threshold value. The indications given by the indication lights 22, 24, 34 and 38 are described for purposes of example only and the indication light can be caused to indication any function performed by the portable trash compactor 10 of the present invention.

FIG. 12 shows decorative designs applied to the outer housing 12 of the portable trash compactor 10 of the present invention. The present invention may have different shapes and designs for a pleasant aesthetic effect. Shown are a few potential designs that may be employed without deviating from the functionality or objectives of the present invention.

Figure 13:
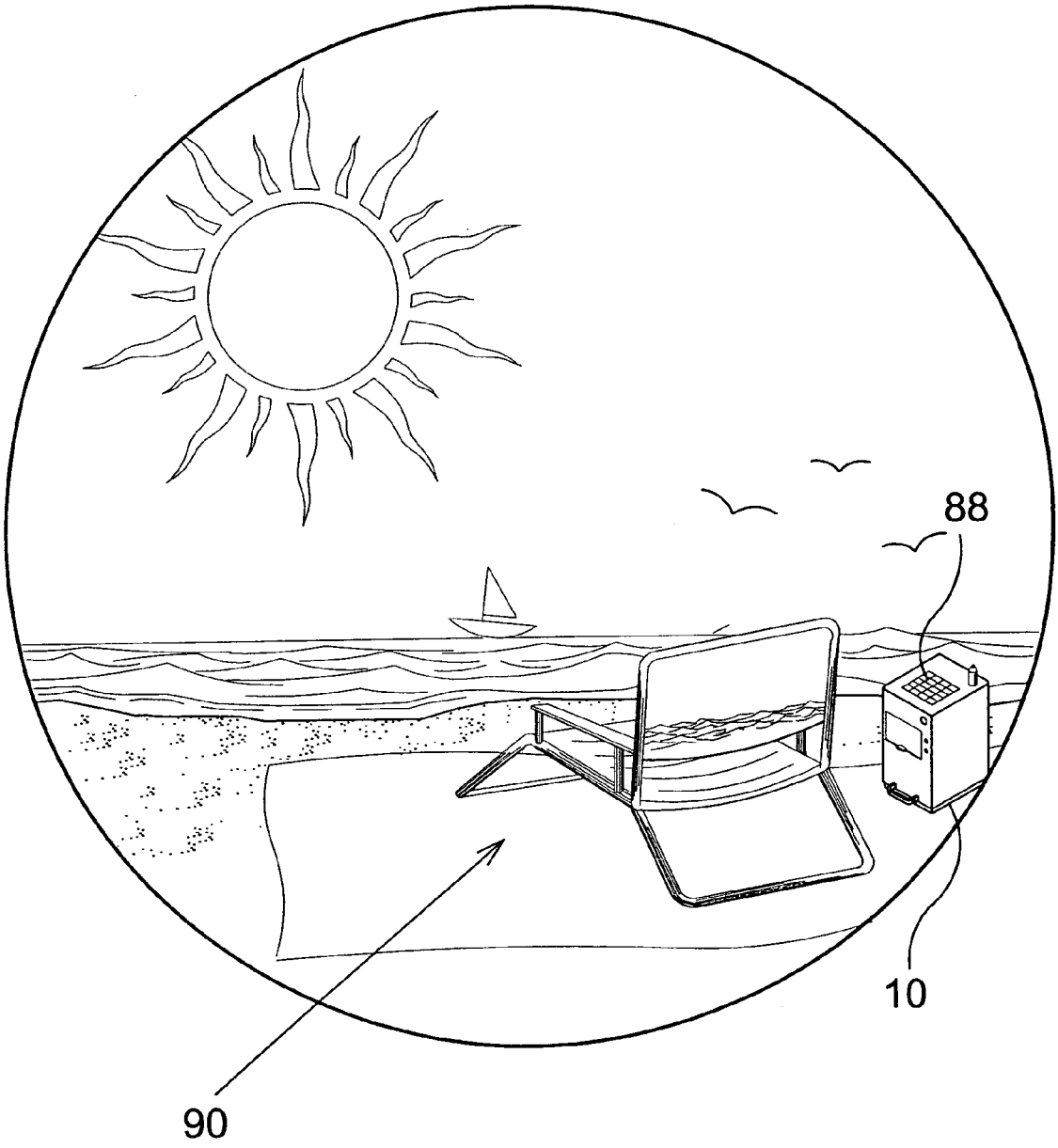
FIG. 13 is an illustrative view of the portable trash compactor of the present invention in use at the beach.

FIG. 13 is an illustrative view of the portable trash compactor of the present invention in use at the beach. The portable trash compactor 10 includes the outer housing 12 and the inner housing 14. The inner housing 14 fits within the outer housing 12 and the outer housing is sliable along the track 21 extending along the height of the inner housing 14 in order to provide access to the compartment 40 as shown in FIG. 4 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. As shown in FIG. 4, positioned within the compartment 40 of the inner housing 14 is the refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes an operation button 26 for selectively operating the portable trash compactor 10 of the present invention. Operation of the portable trash compactor is discussed hereinabove with specific reference to FIGS. 5 and 6.

The portable trash compactor 10 further includes the detachable handle 28 for easily transporting thereof. The detachable handle 28 is connected to the outer housing 12 via at least one of a snap and button. The detachable handle 28 is preferably positioned on a top side of the outer housing 12. However, the detachable handle 28 may be positioned on any side of the portable trash compactor 10 of the present invention so long as it provides for easy carrying and transport of the portable trash compactor 10.

The portable trash compactor 10 is powered by at least one of an external power source and an internal power source. The external power source is at least one of an AC power source or a DC power source. The outer housing 12 includes a power cord compartment 30 for storing a retractable power cord 32. The retractable power cord 32 is selectively connectable to at least one of an AC and DC power source. Preferably, the retractable power cord 32 is an adapter for receipt by a cigarette lighter of a vehicle. However, the retractable power cord 32 can selectively connect the portable trash compactor 10 to any external power source. Additionally, a power connection port 36 is positioned on a side of the outer housing 12. The power connection port 36 is able to receive a power cord (not shown) for connecting the portable trash compactor 10 to an external power source. The portable trash compactor 10 may include a rechargeable battery 58 as shown in FIGS. 5 and 6 for providing power thereto. The rechargeable battery 58 is recharged upon the portable trash compactor 10 being connected to an external power source.

The portable trash compactor 10 also includes a first indication light 22, second indication light 24, third indication light 34 and fourth indication light 38. The number of indication lights is described for purposes of example only and the portable trash compactor 10 may include any number of indication lights. The indication lights 22, 24, 34 and 38 indicated various functions being performed by the portable trash compactor 10. Preferably, the first indication light 22 signifies that the refuse bin 42 is filled to capacity with refuse 50 thus signaling a user to begin compacting. The second indication light 24 may indicate that the compacting function is either in progress or that it is safe to access the compartment 40 of the inner housing 14. This may be accomplished by having the second indication light illuminate a first color when the compactor 10 is compacting the refuse and illuminate a second different color when it is safe to retrieve the compacted refuse. It is also preferable that the third and fourth indication lights 34 and 38, respectively, indicate the level of power stored within the rechargeable power source 58. The third indication light 34 is illuminated when the rechargeable power source is at full capacity whereas the fourth indication light is illuminated when the level of power stored within the rechargeable power source falls below a threshold value. The indications given by the indication lights 22, 24, 34 and 38 are described for purposes of example only and the indication light can be caused to indication any function performed by the portable trash compactor 10 of the present invention.

The embodiment shown in FIG. 13 includes a solar panel 88 positioned on a top end of the outer housing 12. The solar panel 88 allows the internal rechargeable power source 58 to be recharged as well as provides sufficient power to operate the portable trash compactor of the present invention. Preferably, the trash compactor 10 having the solar panel 88 is ideal for use in an outdoor setting such as the beach.

Figure 14:
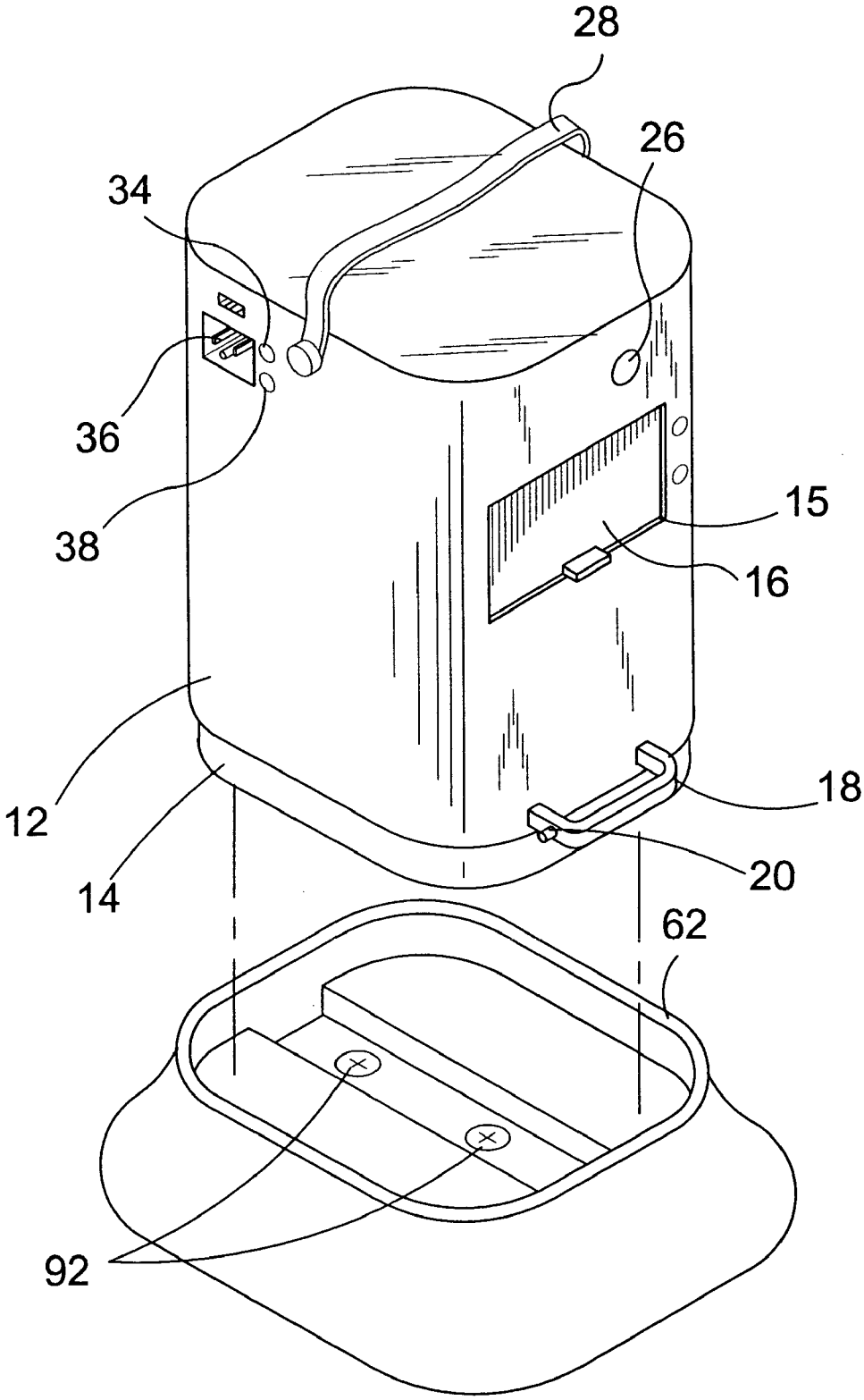
FIG. 14 is a perspective view of the portable trash compactor of the present invention detached from a mounting console.

FIG. 14 is a perspective view of the portable trash compactor of the present invention detached from a mounting console. The portable trash compactor 10 includes the outer housing 12 and the inner housing 14. The inner housing 14 fits within the outer housing 12 and the outer housing is sliable along the track 21 extending along the height of the inner housing 14 in order to provide access to the compartment 40 as shown in FIG. 4 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. As shown in FIG. 4, positioned within the compartment 40 of the inner housing 14 is the refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes an operation button 26 for selectively operating the portable trash compactor 10 of the present invention. Operation of the portable trash compactor is discussed hereinabove with specific reference to FIGS. 5 and 6.

The portable trash compactor 10 further includes the detachable handle 28 for easily transporting thereof. The detachable handle 28 is connected to the outer housing 12 via at least one of a snap and button. The detachable handle 28 is preferably positioned on a top side of the outer housing 12. However, the detachable handle 28 may be positioned on any side of the portable trash compactor 10 of the present invention so long as it provides for easy carrying and transport of the portable trash compactor 10.

The portable trash compactor 10 is powered by at least one of an external power source and an internal power source. The external power source is at least one of an AC power source or a DC power source. The outer housing 12 includes a power cord compartment 30 for storing a retractable power cord 32. The retractable power cord 32 is selectively connectable to at least one of an AC and DC power source. Preferably, the retractable power cord 32 is an adapter for receipt by a cigarette lighter of a vehicle. However, the retractable power cord 32 can selectively connect the portable trash compactor 10 to any external power source. Additionally, a power connection port 36 is positioned on a side of the outer housing 12. The power connection port 36 is able to receive a power cord (not shown) for connecting the portable trash compactor 10 to an external power source. The portable trash compactor 10 may include a rechargeable battery 58 as shown in FIGS. 5 and 6 for providing power thereto. The rechargeable battery 58 is recharged upon the portable trash compactor 10 being connected to an external power source.

The portable trash compactor 10 also includes a first indication light 22, second indication light 24, third indication light 34 and fourth indication light 38. The number of indication lights is described for purposes of example only and the portable trash compactor 10 may include any number of indication lights. The indication lights 22, 24, 34 and 38 indicated various functions being performed by the portable trash compactor 10. Preferably, the first indication light 22 signifies that the refuse bin 42 is filled to capacity with refuse 50 thus signaling a user to begin compacting. The second indication light 24 may indicate that the compacting function is either in progress or that it is safe to access the compartment 40 of the inner housing 14. This may be accomplished by having the second indication light illuminate a first color when the compactor 10 is compacting the refuse and illuminate a second different color when it is safe to retrieve the compacted refuse. It is also preferable that the third and fourth indication lights 34 and 38, respectively, indicate the level of power stored within the rechargeable power source 58. The third indication light 34 is illuminated when the rechargeable power source is at full capacity whereas the fourth indication light is illuminated when the level of power stored within the rechargeable power source falls below a threshold value. The indications given by the indication lights 22, 24, 34 and 38 are described for purposes of example only and the indication light can be caused to indication any function performed by the portable trash compactor 10 of the present invention.

The portable trash compactor 10 of the present invention can be manufactured in a variety of shapes and sizes that allow for portability. Preferably, the height is 15" and the width is between 8–10". Shown in FIG. 14, the portable trash compactor 10 is releasably securable within the base 62. The base 62 is releasable securable to a surface via fasteners 92. The base 62 is substantially the same size and shape of the inner housing 14. Upon positioning the portable trash compactor 10 within the base 62, the portable trash compactor 10 is secured therein and can be selectively operated by a user.

Figure 15:
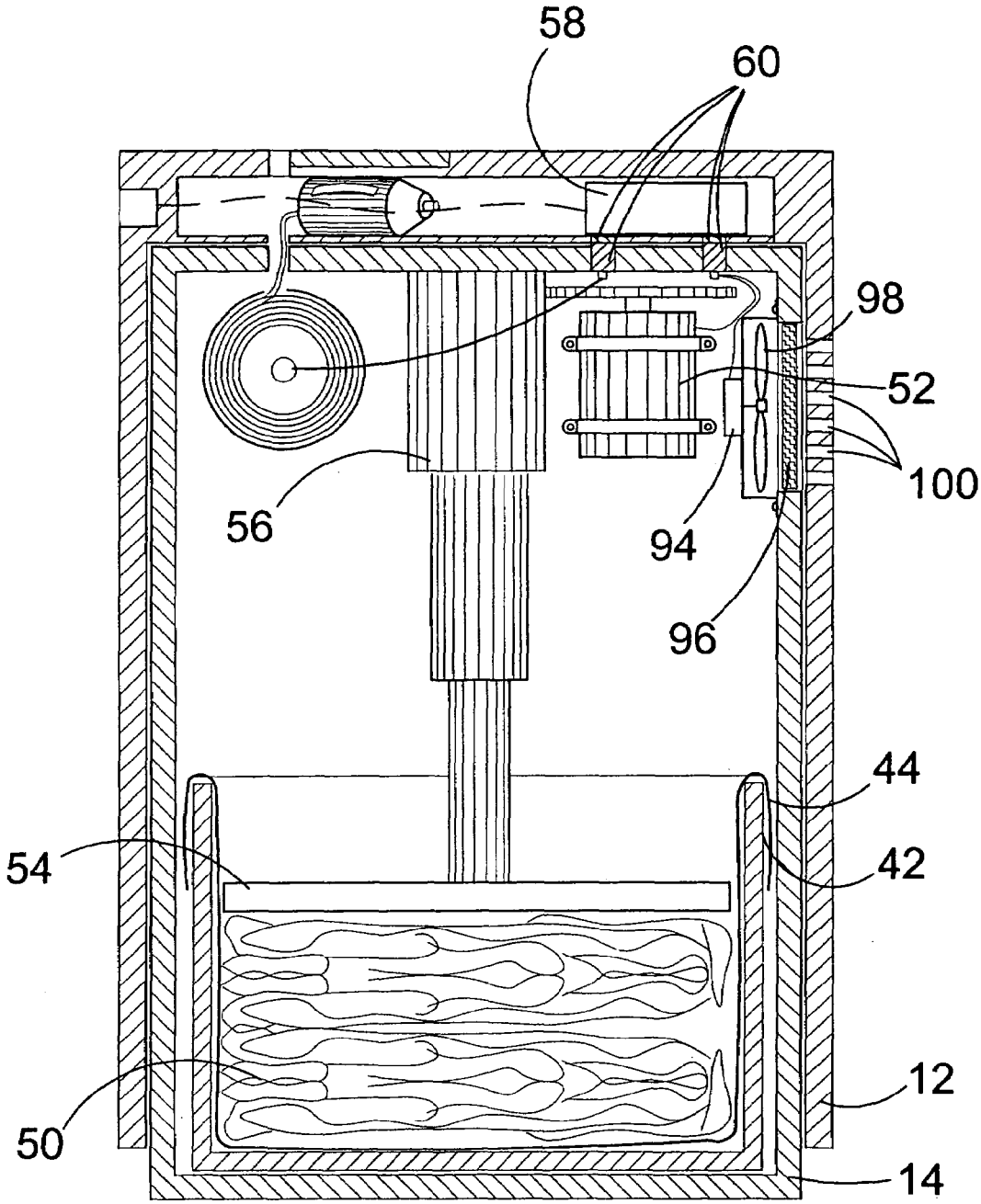
FIG. 15 is a cross-sectional front view of the portable trash compactor of the present invention including an air freshening device.

FIG. 15 is a cross-sectional front view of the portable trash compactor of the present invention including an air freshening device. The portable trash compactor 10 includes the outer housing 12 and the inner housing 14. The inner housing 14 fits within the outer housing 12 and the outer housing is sliable along the track 21 extending along the height of the inner housing 14 in order to provide access to the compartment 40 as shown in FIG. 4 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. As shown in FIG. 4, positioned within the compartment 40 of the inner housing 14 is the refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes an operation button 26 for selectively operating the portable trash compactor 10 of the present invention. Operation of the portable trash compactor is discussed hereinabove with specific reference to FIGS. 5 and 6.

A compacting mechanism is position on an inner side of the outer housing 12 at an end opposite the inner housing 14. The compacting mechanism includes a motor 52 connected to a drive mechanism 56. The motor 52 selectively controls the operation of the drive mechanism 56. A ram 54 is connected to an end of the drive mechanism 56. Upon activation of the motor 52, the drive mechanism 56 is caused to extend in a direction towards the refuse 50 within the refuse bag 44 positioned within the refuse bin 42. Upon extending the drive mechanism 56 the ram exerts pressure on the refuse 50 and caused the refuse to be compacted. A pressure sensor detects the amount of pressure exerted on the refuse 50 and, upon a predetermined amount of pressure being exerted thereon, the sensor signals the motor 52 to cause the drive member 56 to retract in a direction opposite the refuse 50. Thereafter, a user can selectively press the lock release button 20 on the handle 18 and slide the outer housing 12 along the track 21 of the inner housing 14 and remove the compacted refuse 50 from the refuse bin 42. As shown in FIG. 6, the refuse 50 has been fully compacted and is ready for removal from the portable trash compactor 10.

The portable trash compactor 10 as shown in FIG. 15 includes an air freshening device. The outer housing 12 includes a vent 100. Positioned on an inner surface of the outer housing 12 is a fan motor 94. Preferably, the fan motor 94 is adjacent to the motor 52. A fan blade 98 is connected to the fan motor 94 and an air freshener 96 is positioned on a side of the fan blade 98 opposite the fan motor 94. When the user depresses the operation button 26, and the motor 52 causes the drive mechanism 56 to be extended for compacting refuse, the fan motor 94 is engaged and causes the fan blade 98 to spin. As the fan blade 98 spins, the air freshener 96 is caused to blow through the vent 100 for freshening the surrounding area.

Figure 16:
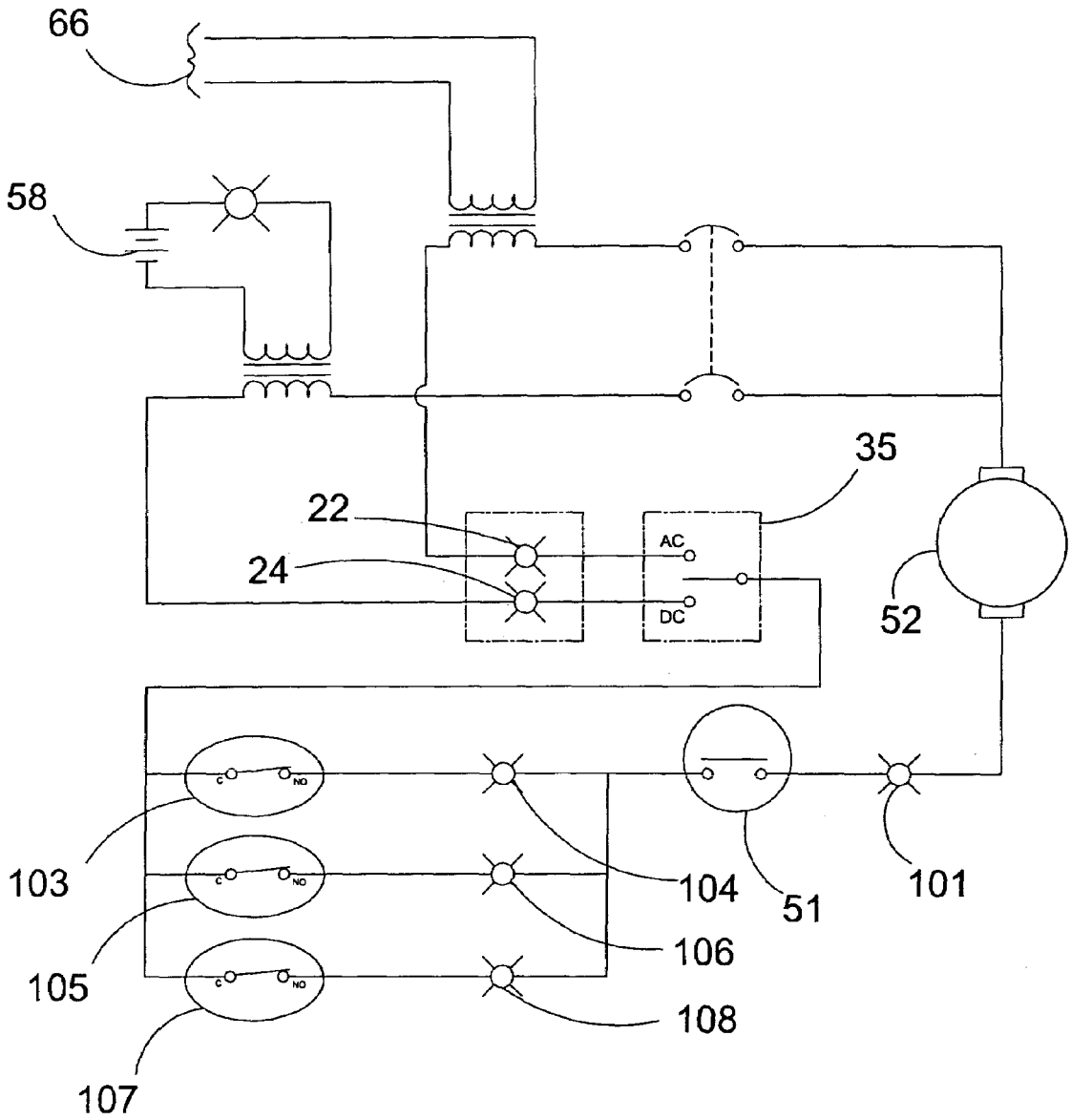
FIG. 16 is a schematic diagram of the portable trash compactor of the present invention.

FIG. 16 is a schematic diagram of the portable trash compactor of the present invention. The schematic details the operation of the indications lights of the portable trash compactor 10. The portable trash compactor 10 can be powered by at least one of an external power source 66 and an internal rechargeable power source 58. Preferably, the external power source 66 is an AC power source. A power selection switch 35 detects the type of power being used by the portable trash compactor 10. Upon determining that AC power is being used by the portable trash compactor 10, the power selection switch moves from a neutral position to a first closed position. When the power selection switch 35 is in the first closed position a first indication light 22 is caused to be illuminated signifying that the portable trash compactor 10 is being operated using AC power. If the power selector switch determines that the power being used by the portable trash compactor 10, the power selection switch 35 moves from the neutral position to the second closed position. When the power selection switch is in the second closed position, a second indication light 24 is caused to be illuminated thereby signifying that the portable trash compactor 10 is being operated using DC power.

The motor 52 is powered by at least one of the external power source 66 and the internal power source 58. Upon activation of the motor 52, an operation switch 51 is moved from a first open position to a second closed position thereby completing an electrical circuit. The portable trash compactor 10 includes a plurality of sensors for sensing various operating conditions thereof. A door sensor determines whether the access door 16 as shown in FIG. 3 is in an open position or a closed position. If the door sensor determines the door is in an open position, then the door sensor switch 103 is in the first open position. If the access door 16 is in the closed position, the door sensor switch 103 is caused to move into the second closed position. A door indication light 104 is caused to be illuminated when the door sensor switch 103 is in the second closed position. A compactor sensor determines the amount of refuse currently in the refuse bin 42. If the amount of refuse in the refuse bin 42 is above a predetermined level, then the compactor sensor causes a compactor switch 105 to move from a first open position to a second closed position. Upon the compactor switch 105 being moved into the second closed position, a compactor full light 106 is caused to be illuminated thereby signifying that the compactor is full. A drive mechanism sensor may also be included to detect proper operation of the drive mechanism 56. If the drive mechanism 56 is determined to be working properly, a drive mechanism sensor switch 107 remains in a first open position. If the drive mechanism 56 is no operating correctly, the drive mechanism sensor switch 107 is caused to move into the second closed position. Upon the drive mechanism sensor switch 107 being in the second closed position, a drive failure light 108 is caused to be illuminated.

The sensors are described for purposes of example only, and the portable trash compactor 10 of the present invention may include any sensor which would ensure proper operation thereof. Additionally, the indication lights corresponding to the sensors described above, were described for purposes of Examples only, and the portable trash compactor 10 of the present invention may include any number of indication lights each corresponding to a sensor for illumination thereof.

Figure 17:
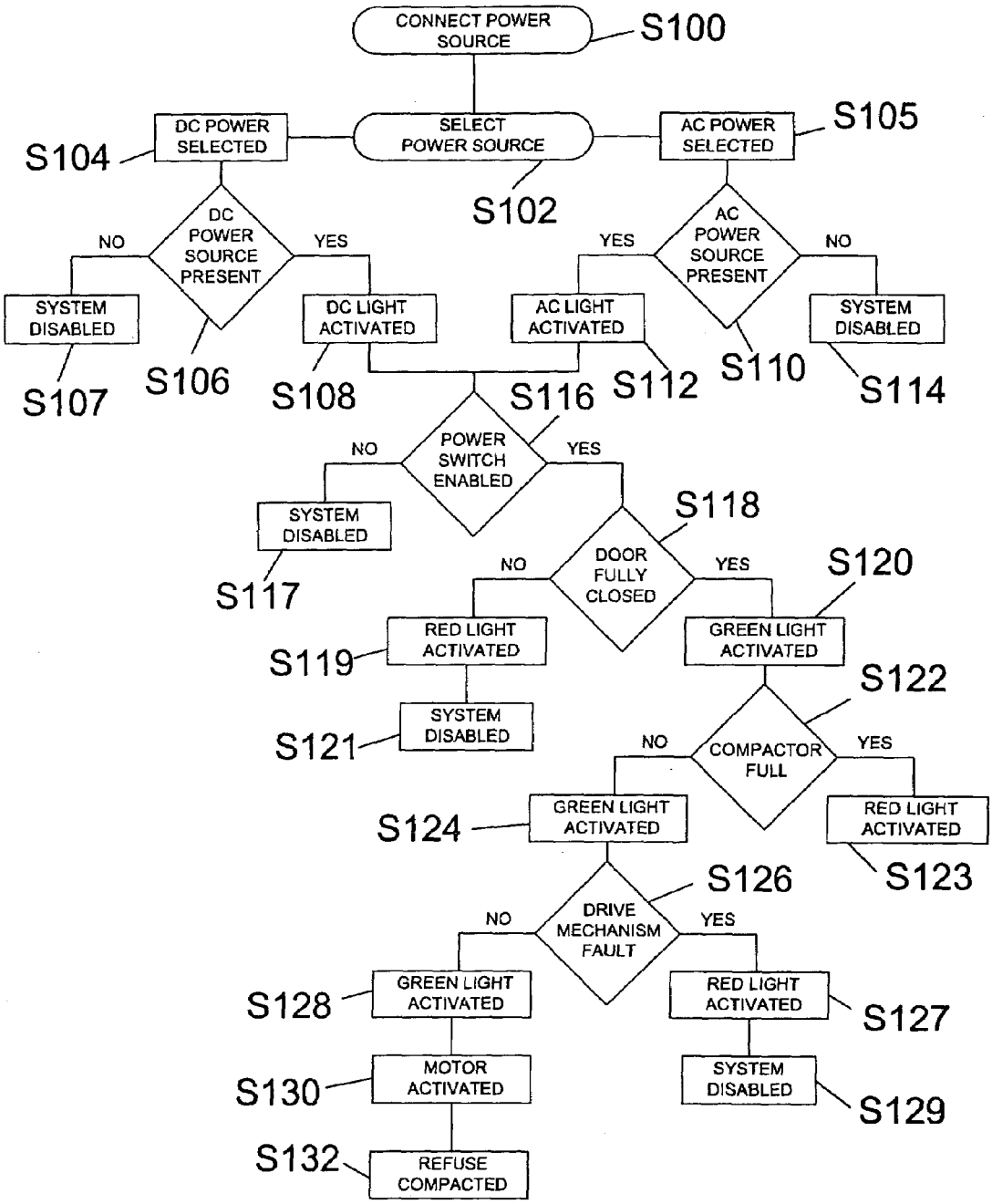
FIG. 17 is a flow chart detailing the operation of the portable trash compactor of the of the present invention.

FIG. 17 is a flow chart detailing the operation of the portable trash compactor of the of the present invention. Prior to operation of the portable trash compactor 10, the portable trash compactor 10 must be connected to a power source as shown in step S100. Thereafter, a type of power source is selected as shown in step S102. The portable trash compactor 10 can select a DC power source as in step S104 and if the DC power source is present as in step 106, then a DC light is activated as shown in step 108. If no DC power source is present in step S106, then the system is disabled as shown in step S107. Alternatively, an AC power source can be selected as shown in step S105. If an AC power source is present as shown in step S110, then an AC light is activated as shown in step S112. If no AC power source is detected in step S110, then the system is disabled as in step S114.

Upon either the DC light being activated in step S108 or the AC light being activated as in step S112, step S116 determines if the power switch has been activated. If the power switch has not been activated, then the system is disabled as in step S117. If the power switch of step S116 has been activated, then it is determined whether the access door is closed as shown in step S118. If the access door is not closed, then a first light is illuminated as stated in step S119 and the system is disabled as in step S121. Preferably, the first light is red to indicate that the portable trash compactor 10 is not operable. If the access door is fully closed then a second light is illuminated as shown in step S120. Preferably, the second light is a green light to indicate that the portable trash compactor is operating correctly. After the second light is illuminated in step S120, the amount of refuse currently in the refuse bin 42 is detected in step S122. If the compactor is not full, then a third light is caused to be illuminated as stated in step S123. Preferably, the third light is also red to indicate that the portable trash compactor is not full. If the compactor is full, then a fourth light is caused to be illuminated as shown in step S124. Preferably, the fourth light is green to indicate that the compactor is full and that compacting should be commenced.

Upon determining that the compactor is full in step S122 and causing the fourth light to be illuminated as in step S124, a determination as to whether the drive mechanism 56 of the portable trash compactor 10 is working correctly as stated in step S126. If the drive mechanism 56 is not operating correctly, then a fifth indication light is caused to be illuminated as in step S127 and the system is disabled as in step S129. Preferably, the fifth indication light is red so as to indicate that the drive mechanism 56 of the portable trash compactor 10 is not operating correctly. If the drive mechanism 56 is deteremined to be operating correctly, then a sixth indication light is caused to be illuminated as in step S128 and the motor 52 is activated as shown in step S130. Preferably, the sixth indication light is a green light to indicate proper operation of the drive mechanism. After the motor 52 has been activated as shown in step S130, the refuse in the refuse bin 42 is compacted by the ram 54 of the driving mechanism as shown in step S132.

Figure 18:
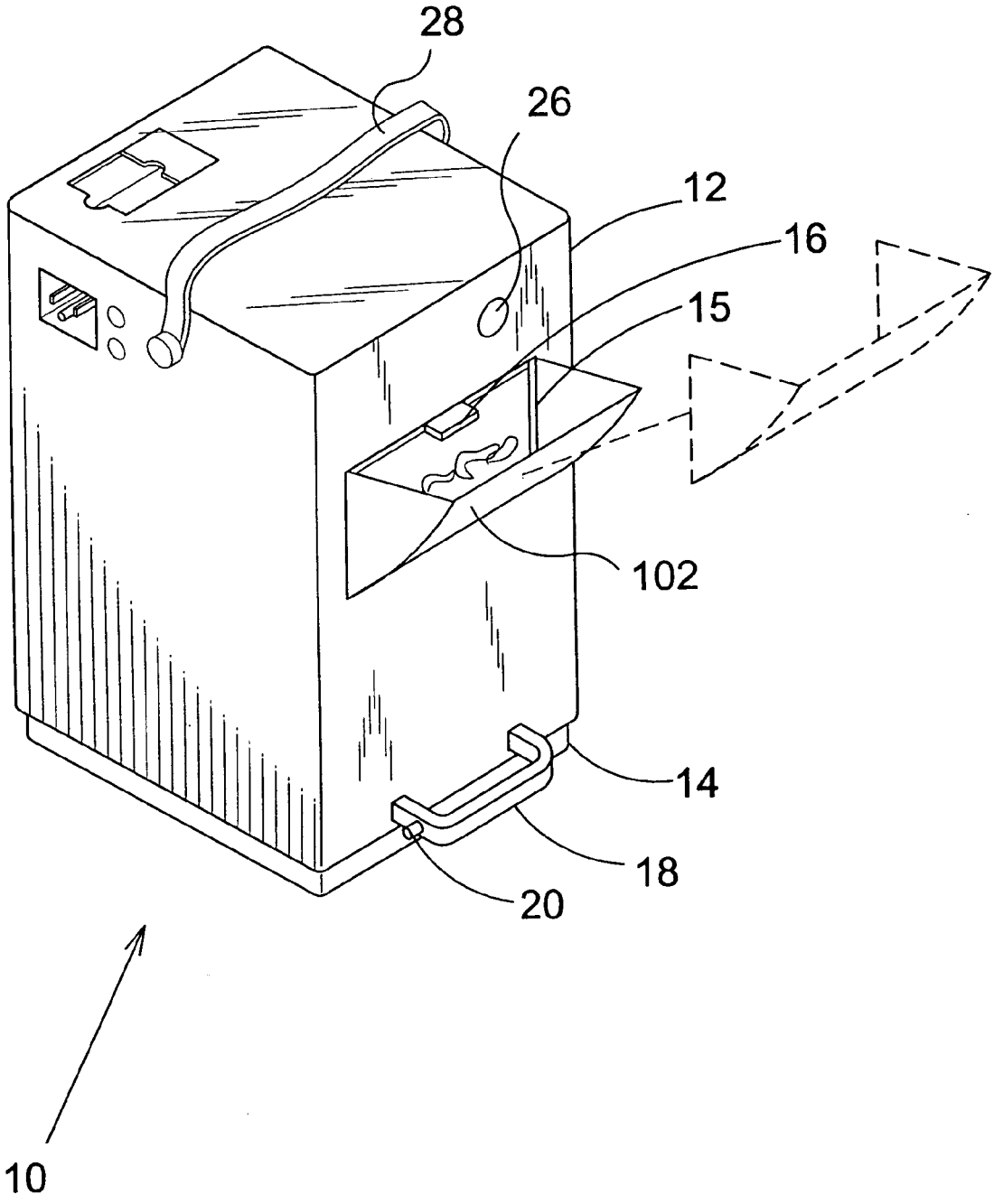
FIG. 18 is a perspective view of the portable trash compactor of the present invention including a slide for aiding is receiving refuse therein.

FIG. 18 is a perspective view of the portable trash compactor of the present invention including a slide for aiding is receiving refuse therein. The portable trash compactor 10 includes the outer housing 12 and the inner housing 14. The inner housing 14 fits within the outer housing 12 and the outer housing is sliable along the track 21 extending along the height of the inner housing 14 in order to provide access to the compartment 40 as shown in FIG. 4 of the inner housing 14. The lifting handle 18 including the lock release button 20 is positioned on the outer housing 12. Upon depressing the lock release button 20, the outer housing 12 is released from the inner housing 14 thereby allowing the user to use the lifting handle 18 to selectively slide the outer housing 12 along the height of the inner housing 14. As shown in FIG. 4, positioned within the compartment 40 of the inner housing 14 is the refuse bin 42. The refuse bin 42 is substantially the same size as the compartment 40 if the inner housing 14. The reusable refuse bag 44 is positioned within the refuse bin 42 for receiving refuse 50 therein.

The outer housing 12 further includes a recess 15 extending through the front side thereof. The access door 16 of substantially the same size and shape of the recess 15 is connected to the outer housing 12 for selectively providing access to the recess 15. Upon opening the access door 16, a user is able to deposit refuse therein for receipt within the inner housing. Upon the compartment 40 of the inner housing being filled to a predetermined level with refuse, the refuse is compacted. The outer housing also includes an operation button 26 for selectively operating the portable trash compactor 10 of the present invention. Operation of the portable trash compactor is discussed hereinabove with specific reference to FIGS. 5 and 6.

The portable trash compactor 10 further includes the detachable handle 28 for easily transporting thereof. The detachable handle 28 is connected to the outer housing 12 via at least one of a snap and button. The detachable handle 28 is preferably positioned on a top side of the outer housing 12. However, the detachable handle 28 may be positioned on any side of the portable trash compactor 10 of the present invention so long as it provides for easy carrying and transport of the portable trash compactor 10.

The portable trash compactor 10 is powered by at least one of an external power source and an internal power source. The external power source is at least one of an AC power source or a DC power source. The outer housing 12 includes a power cord compartment 30 for storing a retractable power cord 32. The retractable power cord 32 is selectively connectable to at least one of an AC and DC power source. Preferably, the retractable power cord 32 is an adapter for receipt by a cigarette lighter of a vehicle. However, the retractable power cord 32 can selectively connect the portable trash compactor 10 to any external power source. Additionally, a power connection port 36 is positioned on a side of the outer housing 12. The power connection port 36 is able to receive a power cord (not shown) for connecting the portable trash compactor 10 to an external power source. The portable trash compactor 10 may include a rechargeable battery 58 as shown in FIGS. 5 and 6 for providing power thereto. The rechargeable battery 58 is recharged upon the portable trash compactor 10 being connected to an external power source.

The portable trash compactor 10 also includes a first indication light 22, second indication light 24, third indication light 34 and fourth indication light 38. The number of indication lights is described for purposes of example only and the portable trash compactor 10 may include any number of indication lights. The indication lights 22, 24, 34 and 38 indicated various functions being performed by the portable trash compactor 10. Preferably, the first indication light 22 signifies that the refuse bin 42 is filled to capacity with refuse 50 thus signaling a user to begin compacting. The second indication light 24 may indicate that the compacting function is either in progress or that it is safe to access the compartment 40 of the inner housing 14. This may be accomplished by having the second indication light illuminate a first color when the compactor 10 is compacting the refuse and illuminate a second different color when it is safe to retrieve the compacted refuse. It is also preferable that the third and fourth indication lights 34 and 38, respectively, indicate the level of power stored within the rechargeable power source 58. The third indication light 34 is illuminated when the rechargeable power source is at full capacity whereas the fourth indication light is illuminated when the level of power stored within the rechargeable power source falls below a threshold value. The indications given by the indication lights 22, 24, 34 and 38 are described for purposes of example only and the indication light can be caused to indication any function performed by the portable trash compactor 10 of the present invention.

FIG. 18, includes a detachable refuse slide 102 detachably connected adjacent the recess 15 in the outer housing 12. Upon connecting the slide 102 to outer housing 12, the slide 102 causes the access door 16 to be held in an open position thus allowing a user to more easily dispose of refuse by allowing the refuse to be poured through the recess 15 for receipt by the refuse bin 42. After the user is finished disposing of refuse, the slide 102 can be detached for easy transport and storage of the portable trash compactor 10.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An portable apparatus for compacting refuse comprising:

a) an outer housing having a recess extending therethrough and a vent extending therethrough;

b) an inner housing received within said outer housing so as to form a compartment for receiving refuse therein;

c) means for releaseably connecting said outer housing to said inner housing;

d) a base including a mounting port for selectively receiving said outer and inner housing, said base is selectively mountable on a center console in a vehicle;

e) means for compacting the refuse within said compartment;

f) means for freshening an area around said apparatus; and g) an activation button connected to said compacting means, wherein upon refuse being received within said compartment through said recess, said activation button is activated and said compacting means causes the refuse to be compacted and said freshening means spraying an air freshening mist though said vent thereby causing the area around said apparatus to be made fresh.

2. The apparatus as recited in claim 1, further comprising a lock for locking said outer housing to said inner housing.

3. The apparatus as recited in claim 2, further comprising a release button for selectively unlocking said lock thereby releasing said outer housing from said inner housing.

4. The apparatus as recited in claim 1, further comprising a refuse bin positioned within said compartment for receiving refuse therein.

5. The apparatus as recited in claim 1, wherein said compacting means is positioned on an inner surface of said outer housing opposite said compartment.

6. The apparatus as recited in claim 1, wherein said compacting means includes:

a) a motor;

b) a drive mechanism connected to said motor; and c) a ram connected to said drive mechanism, wherein upon activation of said activating button, said motor causes said drive mechanism to extend said ram in a direction towards said compartment causing said ram to exert a pressure on the refuse contained within said compartment thereby compacting the refuse.

7. The apparatus as recited in claim 6, wherein said compacting means further comprising a pressure sensor for sensing an amount of pressure exerted on the refuse within said compartment, wherein upon determining said exerted pressure is above a predetermined level, said pressure sensor signals said motor to retract said driving mechanism.

8. The apparatus as recited in claim 1, wherein said air freshening means includes:

a) a fan; and b) a spray device storing the air freshening mist positioned between said fan and said vent, wherein upon a drive mechanism of said compacting means being extended, said fan causes said air freshening mist to be released from said spray device through said vent.

9. The apparatus as recited in claim 1, further comprising a portable power source, said power source is at least one of an external AC power source, an external DC power source, a solar power source and an internal rechargeable power source.

10. The apparatus as recited in claim 1, further comprising an access door for covering said recess.

11. The apparatus as recited in claim 10, further comprising a detachable slide connected to said recess for receiving refuse thereon and causing the refuse to pass through said recess, said detachable slide moving said access door between a first open position allowing refuse to pass easily therethrough and a second closed position preventing refuse from passing therethrough.

12. The apparatus as recited in claim 1, further comprising a detachable slide connected to said recess for receiving refuse thereon and causing the refuse to pass through said recess.

13. The apparatus as recited in claim 1, further comprising a compartment door hingedly connected to said outer housing for selectively accessing said compartment.

14. The apparatus as recited in claim 1, wherein said outer housing includes a decorative design.

15. The apparatus as recited in claim 1, further comprising a detachable handle for easily transporting said apparatus.

16. The apparatus as recited in claim 1, further comprising a plurality of indicators corresponding to a plurality of operating states of said apparatus.

17. The apparatus as recited in claim 16, wherein said operating states identified by said plurality of indicators include at least one of compartment full, compacting in process, compacting completed, AC power in use, DC power in use, solar power in use, power source fully charged, power source needs recharging and safe to remove refuse.

* * * * *